US011350770B2

(12) United States Patent
Roach-Feig

(10) Patent No.: US 11,350,770 B2
(45) Date of Patent: Jun. 7, 2022

(54) STORAGE, SHIPPING, AND DISPLAY UNIT

(71) Applicant: Signode Industrial Group LLC, Glenview, IL (US)

(72) Inventor: Nancy Roach-Feig, Cinncinnati, OH (US)

(73) Assignee: Signode Industrial Group LLC, Tampa, FL (US)

( * ) Notice: Subject to any disclaimer, the term of this patent is extended or adjusted under 35 U.S.C. 154(b) by 0 days.

(21) Appl. No.: 17/087,179

(22) Filed: Nov. 2, 2020

(65) Prior Publication Data

US 2021/0137285 A1 May 13, 2021

Related U.S. Application Data

(60) Provisional application No. 62/978,968, filed on Feb. 20, 2020, provisional application No. 62/932,286, filed on Nov. 7, 2019.

(51) Int. Cl.
*A47F 5/00* (2006.01)
*B65D 61/00* (2006.01)

(52) U.S. Cl.
CPC ..... *A47F 5/0018* (2013.01); *B65D 61/00* (2013.01)

(58) Field of Classification Search
CPC ..... A47F 5/0018; A47F 5/11; A47B 45/00; A47B 47/0091; A47B 47/06; A47B 87/0207; B65D 61/00
See application file for complete search history.

(56) References Cited

U.S. PATENT DOCUMENTS 1,381,607 A * 6/1921 Weston ..... A47F 5/0018 108/59
1,427,249 A * 8/1922 Weston ..... A47F 5/0018 108/1
2,529,649 A * 11/1950 Coplen ..... A47B 47/021 108/190
3,777,673 A 12/1973 Blazey et al.
4,034,682 A * 7/1977 Bizinover ..... A47B 47/021 108/107
4,182,244 A * 1/1980 Hutchins, Jr. ..... A47B 47/06 108/53.1

(Continued)

FOREIGN PATENT DOCUMENTS

CH 689196 A5 * 12/1998 ..... A47B 63/00
DE 3341335 A1 * 5/1985 ..... A47B 47/06

(Continued)

OTHER PUBLICATIONS

"Great Northern Laminations Pallettop Display", Screen captures from video clip entitled "PalletTop Display—Temporary Retail Shelving Unit," uploaded to YouTube Mar. 5, 2013. Retrieved from Internet via Great Northern Laminations website: https://www.laminationsonline.com/products/pallettop-display/ (6 pages).

(Continued)

*Primary Examiner* — Stanton L Krycinski
(74) *Attorney, Agent, or Firm* — Neal, Gerber & Eisenberg LLP

(57) ABSTRACT

Various embodiments of the present disclosure provide a storage, shipping, and display unit that can be loaded with product, shipped after loading, and used as a display unit after shipment.

23 Claims, 11 Drawing Sheets

(56) References Cited

U.S. PATENT DOCUMENTS

| | | | | |
|---|---|---|---|---|
| 4,491,226 | A * | 1/1985 | Marschak | A47B 45/00 108/187 |
| 4,620,637 | A | 11/1986 | Karashima | |
| 4,800,821 | A * | 1/1989 | Nook | A47B 91/12 108/106 |
| 4,895,382 | A | 1/1990 | Andersson | |
| 4,961,506 | A | 10/1990 | Lang | |
| 4,976,360 | A * | 12/1990 | Zucker | A47F 5/0018 108/190 |
| D365,226 | S | 12/1995 | Goebel | |
| D430,431 | S | 9/2000 | Walter | |
| D462,201 | S | 9/2002 | Palmer | |
| D465,947 | S | 11/2002 | Andersen et al. | |
| D470,340 | S | 2/2003 | Andersen et al. | |
| 6,516,732 | B1 * | 2/2003 | LaCombe | A47B 45/00 108/153.1 |
| 6,520,356 | B2 * | 2/2003 | Miller, Jr. | A47F 5/0018 108/106 |
| D491,754 | S | 6/2004 | Harwanko | |
| D525,051 | S | 7/2006 | Kuelbs et al. | |
| 7,124,695 | B2 * | 10/2006 | Buechler | A47B 45/00 108/180 |
| D609,498 | S | 2/2010 | Wang | |
| 7,762,750 | B2 * | 7/2010 | Sprague | A47B 45/00 410/84 |
| D641,184 | S | 7/2011 | Chen | |
| D677,944 | S | 3/2013 | Lai | |
| 8,690,471 | B2 * | 4/2014 | Wians | A47F 5/0018 403/231 |
| 8,763,820 | B2 | 7/2014 | Hanley | |
| D713,178 | S | 9/2014 | Cohen | |
| 8,833,573 | B2 * | 9/2014 | Tomaszewski | B65D 19/385 211/126.12 |
| 8,950,603 | B2 | 2/2015 | Davis et al. | |
| D723,843 | S | 3/2015 | Lai | |
| 8,985,598 | B2 | 3/2015 | Engum et al. | |
| D730,089 | S | 5/2015 | Carbone | |
| 9,204,737 | B2 * | 12/2015 | Lamarre | A47B 47/0083 |
| D748,416 | S | 2/2016 | Meissner et al. | |
| 9,282,820 | B2 * | 3/2016 | Lo | A47F 5/14 |
| 9,307,834 | B2 * | 4/2016 | Han | A47B 87/0207 |
| D756,690 | S | 5/2016 | Ortega | |
| 9,346,391 | B2 * | 5/2016 | Workman | B60P 3/14 |
| 9,456,688 | B2 * | 10/2016 | Moyer | A47B 47/0091 |
| D781,080 | S | 3/2017 | Jordan et al. | |
| 9,844,281 | B2 * | 12/2017 | Fernandez | A47B 47/0008 |
| D814,410 | S | 4/2018 | Emslie | |
| 10,165,854 | B2 * | 1/2019 | Lim | F16B 12/34 |
| 10,238,207 | B1 * | 3/2019 | Schenker | A47B 47/0083 |
| 10,278,492 | B2 * | 5/2019 | Linden | A47F 5/0018 |
| 10,377,569 | B1 * | 8/2019 | Rollins | A47F 5/0018 |
| 10,433,640 | B2 * | 10/2019 | Sanchez Anton | A47B 47/0091 |
| 10,772,442 | B2 | 9/2020 | Mertz et al. | |
| 2006/0054579 | A1 * | 3/2006 | Choe | A47F 5/0018 211/134 |
| 2009/0032432 | A1 * | 2/2009 | Kostos | B65D 71/0096 206/600 |
| 2013/0295317 | A1 * | 11/2013 | Wu | A47B 96/205 428/99 |
| 2014/0263108 | A1 | 9/2014 | Grey et al. | |
| 2015/0272322 | A1 * | 10/2015 | Wu | A47B 47/005 428/99 |
| 2016/0035255 | A1 * | 2/2016 | Marler | A47B 57/48 211/186 |
| 2017/0164734 | A1 * | 6/2017 | Steele | F16B 12/50 |
| 2018/0317650 | A1 * | 11/2018 | Bova | A47B 45/00 |
| 2020/0024032 | A1 | 1/2020 | Urban et al. | |
| 2020/0132538 | A1 * | 4/2020 | Marivoet | G01G 19/42 |
| 2020/0190837 | A1 * | 6/2020 | Xia | A47B 47/0091 |

FOREIGN PATENT DOCUMENTS

| | | | | |
|---|---|---|---|---|
| DE | 19624437 | C1 * | 11/1997 | A47B 45/00 |
| DE | 202013100231 | U1 | 4/2013 | |
| EP | 0650678 | A1 * | 5/1995 | A47F 5/0018 |
| FR | 1257649 | A * | 4/1961 | A47B 47/05 |
| FR | 2784557 | A1 * | 4/2000 | A47B 47/06 |
| FR | 2891716 | A1 * | 4/2007 | A47F 5/0018 |
| GB | 1354284 | A | 5/1974 | |

OTHER PUBLICATIONS

"Pack-Rack Product", https://pack-rack.nl/en/ (2 pages) available prior to Nov. 7, 2019.

International Search Report for PCT/US2020/058643 dated Feb. 2, 2021.

* cited by examiner

STORAGE, SHIPPING, AND DISPLAY UNIT

PRIORITY CLAIM

This patent application claims priority to and the benefit of U.S. Provisional Patent Application No. 62/932,286, which was filed on Nov. 7, 2019, and U.S. Provisional Patent Application No. 62/978,968, which was filed on Feb. 20, 2020, the entire contents of each of which are incorporated herein by reference.

FIELD

The present disclosure relates to storage, shipping, and display units.

BACKGROUND

In the retail industry, vendors supply products to retailers that in turn sell the products to consumers. A vendor typically packages the products (such as in a box filled with dunnage) before shipping them (such as via truck) to a retailer. After receiving the products, the retailer transfers them to a display rack and discards the packaging. These display racks are typically formed from heavy, non-recyclable material. While the display racks are reusable, they occupy a significant amount of valuable storage space when not being used and require time and labor to set up and take down, which increases costs. In some cases, the vendors ship the display racks to the retailers, in some instances with the display racks assembled and the products packaged on the display racks. Given the size and weight of these display racks, this increases freight costs and limits how far the vendors can ship the products. The vendors typically require the retailers to ship the display racks back to the vendors, which increases costs for the retailers and increases the likelihood that the display racks will be damaged or that a component will be lost in transit.

SUMMARY

Various embodiments of the present disclosure provide a storage, shipping, and display unit that can be loaded with product, shipped after loading, and used as a display unit after shipment.

One embodiment of the storage, shipping, and display unit of the present disclosure includes a frame, a first shelf, and a second shelf. The frame includes spaced-apart first and second shelf supports, spaced-apart first and second stretchers extending between and supported by the first and second shelf supports, and spaced-apart third and fourth shelf supports supported by the first and second stretchers. The first shelf is supported by and extends between the first and second shelf supports. The second shelf is supported by and extends between the third and fourth shelf supports.

DETAILED DESCRIPTION

Figure 1A:
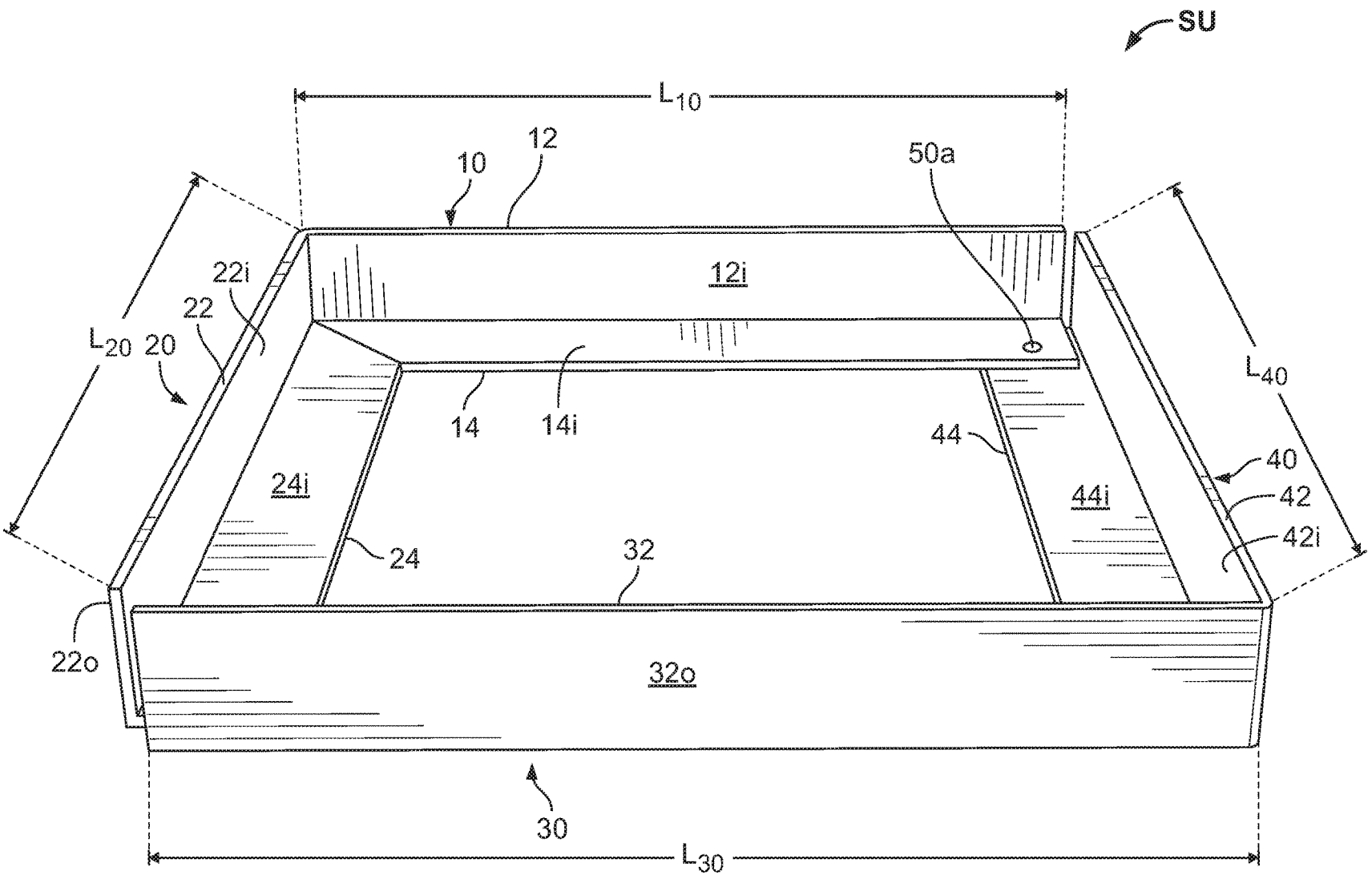
FIGS. 1A and 1B are perspective views of one example embodiment of an example support of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Various embodiments of the present disclosure provide a storage, shipping, and display unit formed from multiple supports, multiple stretchers, multiple vertical stabilizers, and multiple shelves.

Figure 1B:
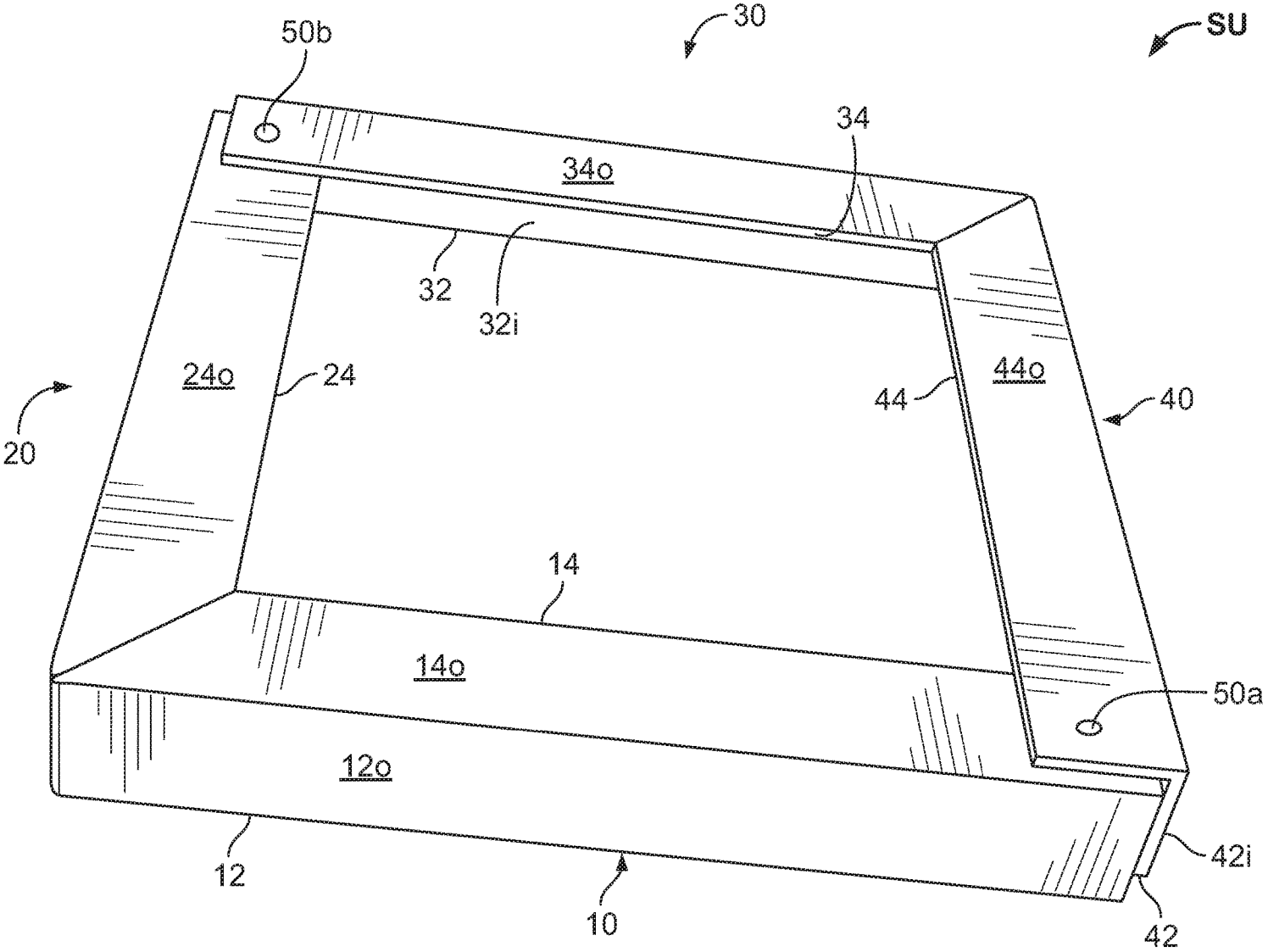

FIGS. 1A and 1B show an example support SU. As described below, the support SU is an example of the base support, the top support, and the shelf supports of the storage, shipping, and display unit. These different types of supports may have different sizes, but include the same components. The support SU includes first, second, third, and fourth legs 10, 20, 30, and 40, respectively, connected to one another and oriented to form a rectangular shape. Each leg includes two transversely oriented walls that (at least in this example embodiment) form an L-shape.

More specifically, the first leg 10 includes a first wall 12 having an outer surface 12*o* and an opposing inner surface 12*i* and a second wall 14 having an outer surface 14*o* and an opposing inner surface 14*i*. The first wall 12 is connected to (and in this embodiment integrally formed with) the second wall 14 and oriented so the first wall 12 is transverse to (and in this embodiment perpendicular to) the second wall 14. The second leg 20 includes a first wall 22 having an outer surface 22*o* and an opposing inner surface 22*i* and a second wall 24 having an outer surface 24*o* and an opposing inner surface 24*i*. The first wall 22 is connected to (and in this embodiment integrally formed with) the second wall 24 and oriented so the first wall 22 is transverse to (and in this embodiment perpendicular to) the second wall 24. The third leg 30 includes a first wall 32 having an outer surface 32*o* and an opposing inner surface 32*i* and a second wall 34 having an outer surface 34*o* and an opposing inner surface 34*i*. The first wall 32 is connected to (and in this embodiment integrally formed with) the second wall 34 and oriented so the first wall 32 is transverse to (and in this embodiment perpendicular to) the second wall 34. The fourth leg 40 includes a first wall 42 having an outer surface 42*o* and an opposing inner surface 42*i* and a second wall 44 having an outer surface 44*o* and an opposing inner surface 44*i*. The first wall 42 is connected to (and in this embodiment integrally formed with) the second wall 44 and oriented so the first wall 42 is transverse to (and in this embodiment perpendicular to) the second wall 44.

As best shown in FIG. 1A, the legs 10, 20, 30, and 40 have respective lengths $L_{10}$, $L_{20}$, $L_{30}$, and $L_{40}$. These lengths generally correspond to the length of the first walls 12, 22, 32, and 42 of the respective legs. The widths and thicknesses (neither of which are labeled) of the walls may be selected as desired for the intended application.

The first leg 10 is connected to the second leg 20, and the first leg 10 and the second leg 20 are oriented transversely to (and in this embodiment perpendicular to) one another. In this example embodiment, the first wall 12 of the first leg 10 and the first wall 22 of the second leg 20 are integrally formed with one another and bent to achieve this orientation. The second leg 20 is connected to the third leg 30, and the second leg 20 and the third leg 30 are oriented transversely to (and in this embodiment perpendicular to) one another. In this example embodiment, the second wall 24 of the second leg 20 and the second wall 34 of the third leg 30 are connected via a connector 50*b* to achieve this orientation. The connector 50*b* may be any suitable connector, such as a mechanical fastener (staple, rivet, etc.); adhesive; or tape. The third leg 30 is connected to the fourth leg 40, and the third leg 30 and the fourth leg 40 are oriented transversely to (and in this embodiment perpendicular to) one another. In this example embodiment, the first wall 32 of the third leg 30 and the first wall 42 of the fourth leg 40 are integrally formed with one another and bent to achieve this orientation. The fourth leg 40 is connected to the first leg 10, and the fourth leg 40 and the first leg 10 are oriented transversely to (and in this embodiment perpendicular to) one another. In this example embodiment, the second wall 44 of the fourth leg 40 and the second wall 14 of the first leg 10 are connected via a connector 50*a* to achieve this orientation. The connector 50*a* may be any suitable connector referenced above.

As best shown in FIG. 1A, opposing pairs of legs of the support SU are approximately the same length so the support SU forms a rectangular shape. That is, in this example embodiment, the lengths $L_{10}$ and $L_{30}$ of the opposing legs 10 and 30 are approximately the same length, and the lengths $L_{20}$ and $L_{40}$ of the opposing legs 20 and 40 are approximately the same length. Varying the lengths $L_{10}$, $L_{20}$, $L_{30}$, and $L_{40}$ of the legs 10, 20, 30, and 40 varies the size of the support SU.

In this example embodiment, the legs 10, 20, 30, and 40 are formed from recycled and recyclable material: multiple plies of paperboard laminated together with a suitable adhesive (such water or non-water-based polyvinyl acetate adhesive, a sodium silicate adhesive, or a potato starch adhesive). In other embodiments, the legs may be formed from any other suitable material, such as non-recycled and/or recyclable material, biodegradable material, plant-based material, and the like.

In other embodiments, the first walls of the second and third legs are integrally formed with one another and bent to achieve the described orientation. In some embodiments, the first walls of the first and fourth legs are integrally formed with one another and bent to achieve the described orientation.

Figure 2:
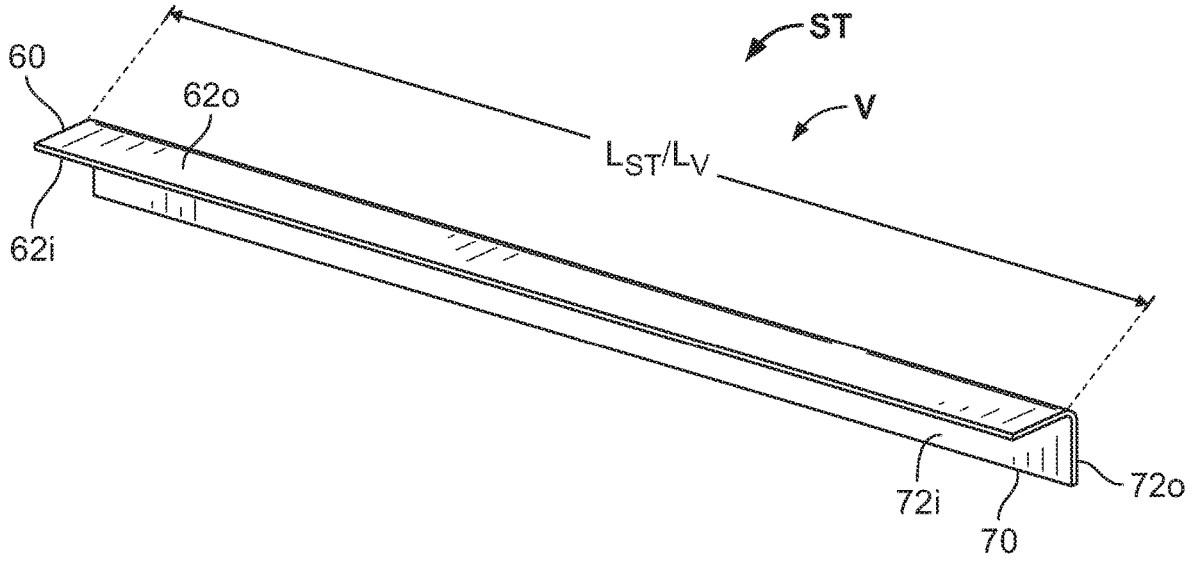
FIG. 2 is a perspective view of one example embodiment of an example stretcher and an example vertical stabilizer of the present disclosure.

FIG. 2 shows an example stretcher ST/vertical stabilizer V. In this example embodiment, the stretchers ST and the vertical stabilizers V are generally the same shape (though may have different sizes) and are shown and described with reference to the single component shown in FIG. 2 for brevity (though in other embodiments these components may differ). The stretcher ST/vertical stabilizer V includes first and second walls 60 and 70, respectively, connected to and transversely oriented relative to one another to form an L-shape. More specifically, the first wall 60 has an outer surface 62*o* and an opposing inner surface 62*i*, and the second wall 70 has an outer surface 72*o* and an opposing inner surface 72*i*. The first wall 60 is connected to (and in this embodiment integrally formed with) the second wall 70 and oriented so the first wall 60 is transverse to (and in this embodiment perpendicular to) the second wall 70.

The stretcher ST/vertical stabilizer V has a length $L_{ST}/L_V$, which generally corresponds to the lengths of the first and second walls 60 and 70. The widths and thicknesses (neither of which are labeled) of the walls may be selected as needed for the desired application of the stretcher ST/vertical stabilizer V.

In this example embodiment, the stretcher ST/vertical stabilizer V is formed from recycled and recyclable material: multiple plies of paperboard laminated together with a suitable adhesive (such a water or non-water-based polyvinyl acetate adhesive, a sodium silicate adhesive, or a potato starch adhesive). In other embodiments, the stretcher/vertical stabilizer may be formed from any other suitable material, such as such as non-recycled and/or recyclable material, biodegradable material, plant-based material, and the like.

Figure 3:
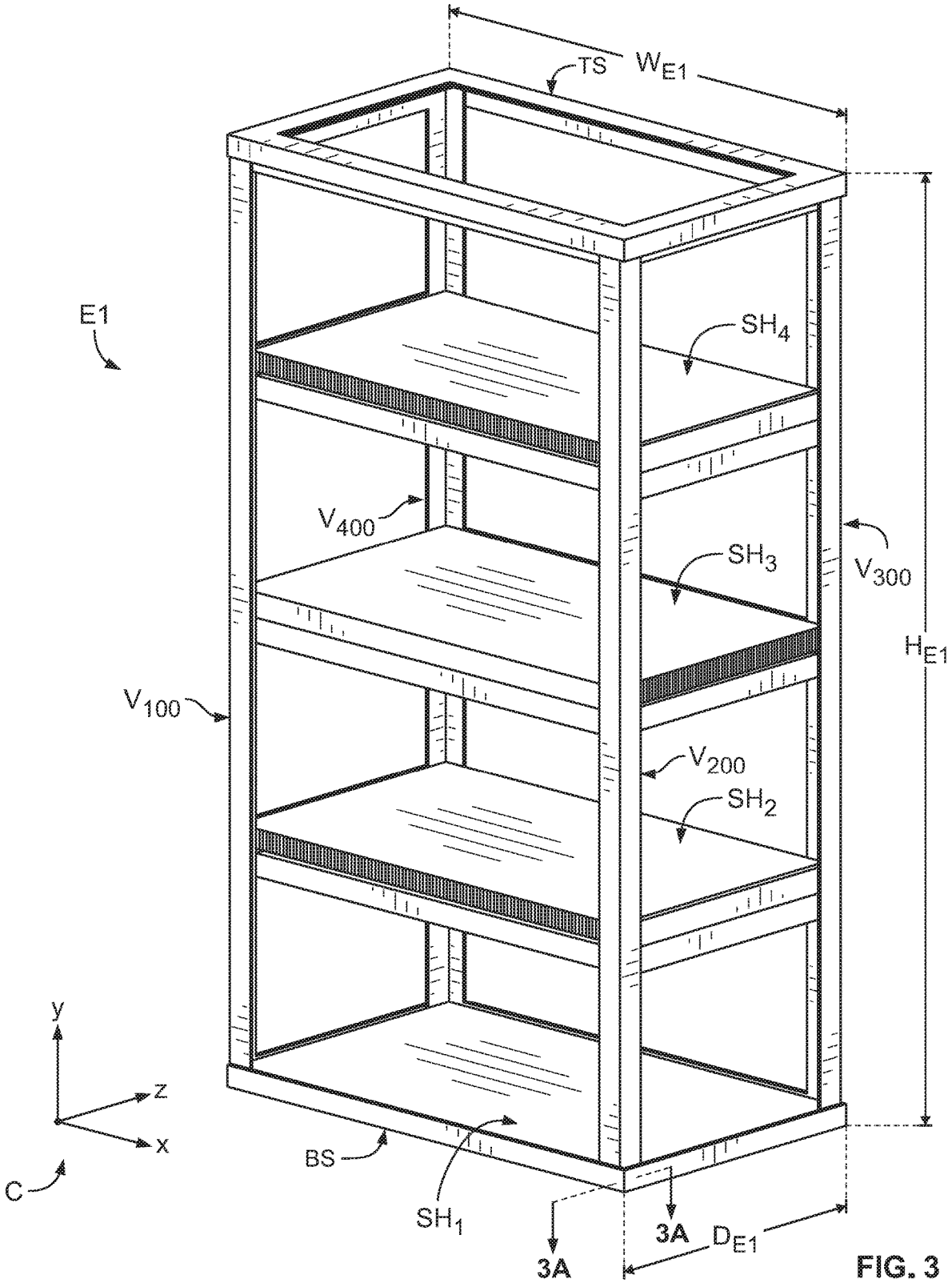
FIG. 3 is a perspective view of one example embodiment of the storage, shipping, and display unit of the present disclosure.
Figure 4:
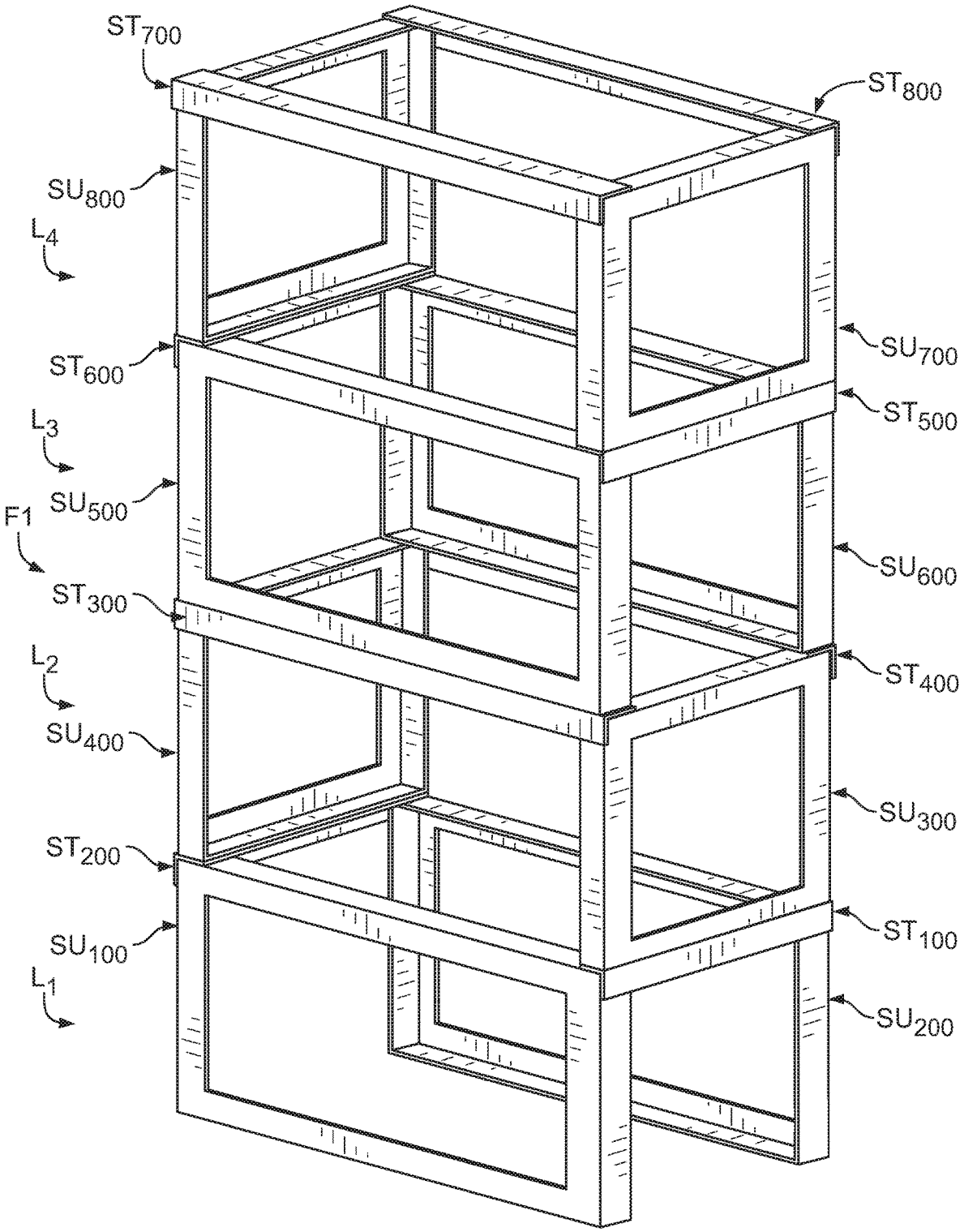
FIGS. 4 and 5 are assembled and exploded perspective views, respectively, of the frame of the storage, shipping, and display unit of FIG. 3.
Figure 5:
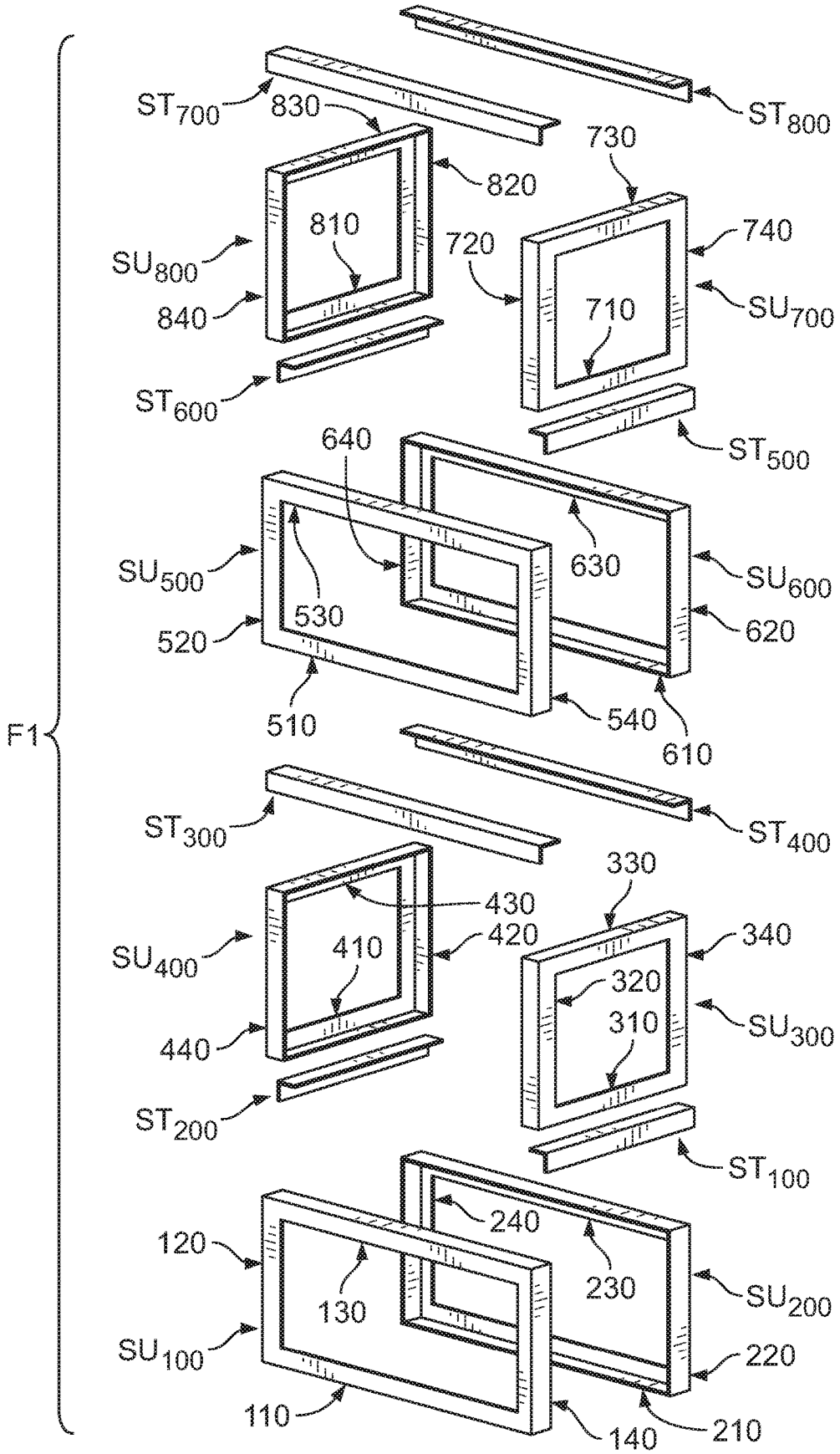

FIGS. 3, 4, and 5 show one example embodiment of the storage, shipping, and display unit E1. The storage, shipping, and display unit E1 includes: a base support BS; shelf supports $SU_{100}$, $SU_{200}$, $SU_{300}$, $SU_{400}$, $SU_{500}$, $SU_{600}$, $SU_{700}$, and $SU_{800}$; a top support TS; stretchers $ST_{100}$, $ST_{200}$, $ST_{300}$, $ST_{400}$, $ST_{500}$, $ST_{600}$, $ST_{700}$, and $ST_{800}$; shelves $SH_1$, $SH_2$, $SH_3$, and $SH_4$; and vertical stabilizers $V_{100}$, $V_{200}$, $V_{300}$, and $V_{400}$. The storage, shipping, and display unit E1 has a height $H_{E1}$, a width $W_{E1}$, and a depth $D_{E1}$. For clarity, the supports are showed in simplified form in the drawings, though they are generally the same as the support SU shown in FIGS. 1A and 1B.

In this example embodiment: the base and top supports BS and TS are the same size and shape; the shelf supports $SU_{100}$, $SU_{200}$, $SU_{500}$, and $SU_{600}$ are the same size and shape; the shelf supports $SU_{300}$, $SU_{400}$, $SU_{700}$, and $SU_{800}$ are the same size and shape; the stretchers $ST_{100}$, $ST_{200}$, $ST_{500}$, and $ST_{600}$ are the same size and shape; the stretchers $ST_{300}$, $ST_{400}$, $ST_{700}$, and $ST_{800}$ are the same size and shape; the vertical stabilizers $V_{100}$-$V_{400}$ are the same size and shape; and the shelves $SH_1$-$SH_4$ are the same size and shape.

Generally, and as best shown in FIGS. 4 and 5, the shelf supports $SU_{100}$-$SU_{800}$ and the stretchers $ST_{100}$-$ST_{800}$ are arranged to form a frame F1 that supports the shelves $SH_1$-$SH_4$ More specifically, the frame F1 is formed of multiple frame layers L1, L2, L3, and L4, each of which includes a spaced-apart pair of the shelf supports $SU_{100}$-$SU_{800}$ that together support one of the shelves $SH_1$-$SH_4$. A pair of the stretchers $ST_{100}$-$ST_{800}$ separates consecutive frame layers. In this example embodiment, the pair of shelf supports in a given frame layer are oriented transversely (and more particularly, perpendicularly) to the pair(s) of shelf supports in the frame layers above and below that given frame layer. Put differently, in this example embodiment the pairs of shelf supports alternate in orientation from frame layer to frame layer. As shown in FIG. 3, the vertical stabilizers $V_{100}$-$V_{400}$ extend along the four corners of the frame F1. The base and top supports BS and TS tie together the bottom and top (respectively) of the frame F1 and the vertical stabilizers $V_{100}$-$V_{400}$.

The orientations of the components of the storage, shipping, and display unit E1 are described below with respect to a coordinate system C shown in FIG. 3. The coordinate system includes X-, Y-, and Z-directions that are transverse to (and here, perpendicular to) one another.

As noted above, the support SU shown in FIGS. 1A and 1B is an example representation of the base support BS, the shelf supports $SU_{100}$-$SU_{800}$, and the top support TS. The components of the supports BS, $SU_{100}$-$SU_{800}$, and TS thus have the same components as the example support SU. For clarity and brevity, the components of the supports BS, $SU_{100}$-$SU_{800}$, and TS are identified below with the same numbering convention used in FIGS. 1A and 1B with the addition of a prefix that corresponds to the particular support: the prefix is "BS" for the base support BS, the prefixes "1" through "8" for the shelf supports $SU_{100}$-$SU_{800}$, and the prefix "TS" for the top support TS. For instance, the first leg of the shelf support $SU_{100}$ is identified using element number 110, and the first wall of the fourth leg of the top support TS is identified using element number TS42. The individual elements of these components are not labeled in the drawings for clarity.

The components of the stretchers $ST_{100}$-$ST_{800}$ have the same components as the example stretcher ST/vertical stabilizer V shown in FIG. 2. For clarity and brevity, the components of the stretchers $ST_{100}$-$ST_{800}$ are identified below with the same numbering convention used in FIG. 2 with the addition of a prefix number that corresponds to the particular stretcher: the prefixes "1" through "8" for the stretchers $ST_{100}$-$ST_{800}$. For instance, the first wall of the stretcher $ST_{300}$ is identified using element number 360. The individual elements of these components are not labeled in the drawings for clarity.

The components of the vertical stabilizers $V_{100}$-$V_{400}$ have the same components as the example stretcher ST/vertical stabilizer V shown in FIG. 2. For clarity and brevity, the components of the vertical stabilizers $V_{100}$-$V_{400}$ are identified below with the same numbering convention used in FIG. 2 with the addition of a prefix number that corresponds to the particular vertical stabilizer: the prefixes "1" through "4" for the vertical stabilizers $V_{100}$-$V_{400}$. For instance, the second wall of the vertical stabilizer $V_{400}$ is identified using element number 470. The individual elements of these components are not labeled in the drawings for clarity.

Starting from the bottom of the storage, shipping, and display unit E1, the base support BS is positioned on (and in some embodiments attached to) and supported by a pallet (not shown) so the outer surfaces BS14*o*, BS24*o*, BS34*o*, and BS44*o* of the second walls BS14, BS24, BS34, and BS44 of the legs BS10, BS20, BS30, and BS40 of the base support BS engage the pallet and so the inner surfaces BS14*i*, BS24*i*, BS34*i*, and BS44*i* of the second walls BS14, BS24, BS34, and BS44 of the legs BS10, BS20, BS30, and BS40 of the base support BS face away from the pallet. The base support BS is oriented generally parallel to the X-Z plane.

The shelf support $SU_{100}$ nests into and is supported by the base support BS. More specifically, the shelf support $SU_{100}$ is positioned and oriented so: (1) the outer surface 112*o* of the first wall 112 of the first leg 110 of the shelf support $SU_{100}$ engages the inner surface BS14*i* of the second wall BS14 of the first leg BS10 of the base support BS; (2) the outer surface 114*a* of the second wall 114 of the first leg 110 of the shelf support $SU_{100}$ engages the inner surface BS12*i* of the first wall BS12 of the first leg BS10 of the base support BS; (3) the fourth leg 140 of the shelf support $SU_{100}$ extends upward in the Y-direction from the junction of the first and second legs BS10 and BS20 of the base support BS, and (4) the second leg 120 of the shelf support $SU_{100}$ extends upward in the Y-direction from the junction of the first and fourth legs BS10 and BS40 of the base support BS. In this orientation, the first and third legs 110 and 130 of the shelf support $SU_{100}$ extend generally horizontally in the X-direction, the second and fourth legs 120 and 140 of the shelf support $SU_{100}$ extend generally vertically in the Y-direction, and the shelf support $SU_{100}$ is oriented generally parallel to the X-Y plane. In certain embodiments, the shelf support $SU_{100}$ is attached to the base support BS in any suitable manner, such as via mechanical fasteners (such as staples, pins, or brads); adhesives; or tape.

The shelf support $SU_{200}$ nests into and is supported by the base support BS. More specifically, the shelf support $SU_{200}$ is positioned and oriented so: (1) the outer surface 212*o* of the first wall 212 of the first leg 210 of the shelf support $SU_{200}$ engages the inner surface BS34*i* of the second wall BS34 of the third leg BS30 of the base support BS; (2) the outer surface 214*a* of the second wall 214 of the first leg 210 of the shelf support $SU_{200}$ engages the inner surface BS32*i* of the first wall BS32 of the third leg BS30 of the base support BS; (3) the fourth leg 240 of the shelf support $SU_{200}$ extends upward in the Y-direction from the junction of the third and fourth legs BS30 and BS40 of the base support BS; and (4) the second leg 220 of the shelf support $SU_{200}$ extends upward in the Y-direction from the junction of the second and third legs BS20 and BS30 of the base support BS. In this orientation, therefore, the first and third legs 210 and 230 of the shelf support $SU_{200}$ extend generally horizontally in the X-direction, the second and fourth legs 220 and 240 of the shelf support $SU_{200}$ extend generally vertically in the Y-direction, and the shelf support $SU_{200}$ is oriented generally parallel to the X-Y plane and spaced-apart from the shelf support $SU_{200}$ in the Z-direction. In certain embodiments, the shelf support $SU_{200}$ is attached to the base support BS in any suitable manner, such as any of those referenced above.

The stretcher $ST_{200}$ is supported by and extends between and connects the shelf supports $SU_{100}$ and $SU_{200}$. More specifically, the stretcher $ST_{100}$ is positioned and oriented so: (1) the inner surface 162*i* of the first wall 160 of the stretcher $ST_{100}$ engages the outer surfaces 132*o* and 232*o* of the first walls 132 and 232 of the third legs 130 and 230 of the shelf supports $SU_{100}$ and $SU_{200}$; and (2) the inner surface 172*i* of the second wall 170 of the stretcher $ST_{100}$ engages the outer surface 142*o* of the first wall 142 of the fourth leg 140 of the shelf support $SU_{100}$ and engages the outer surface 222*o* of the first wall 222 of the second leg 220 of the shelf support $SU_{200}$. In this orientation, the stretcher $ST_{100}$ extends generally horizontally in the Z-direction. In certain embodiments, the stretcher $ST_{100}$ is attached to the shelf supports $SU_{100}$ and $SU_{200}$ in any suitable manner, such as any of those referenced above.

The stretcher $ST_{200}$ is supported by and extends between and connects the shelf supports $SU_{100}$ and $SU_{200}$. More specifically, the stretcher $ST_{200}$ is positioned and oriented so: (1) the inner surface 262*i* of the first wall 260 of the stretcher $ST_{200}$ engages the outer surfaces 132*o* and 232*o* of the first walls 132 and 232 of the third legs 130 and 230 of the shelf supports $SU_{100}$ and $SU_{200}$; and (2) the inner surface 272*i* of the second wall 270 of the stretcher $ST_{200}$ engages the outer surface 122*o* of the first wall 122 of the second leg 120 of the shelf support $SU_{100}$ and engages the outer surface 242*o* of the first wall 242 of the fourth leg 240 of the shelf support $SU_{200}$. In this orientation, the stretcher $ST_{200}$ extends generally horizontally in the Z-direction and is spaced-apart from the stretcher $ST_{100}$ in the X-direction. In certain embodiments, the stretcher $ST_{100}$ is attached to the shelf supports $SU_{100}$ and $SU_{200}$ in any suitable manner, such as any of those referenced above.

The shelf support $SU_{300}$ is supported by the stretcher $ST_{100}$. More specifically, the shelf support $SU_{300}$ is positioned and oriented so: (1) the outer surface 312*o* of the first wall 312 of the first leg 310 of the shelf support $SU_{300}$ engages the outer surface 162*o* of the first wall 162 of the stretcher $ST_{100}$; (2) the second leg 320 of the shelf support $SU_{300}$ extends generally vertically in the Y-direction and is positioned above the fourth leg 140 of the shelf support $SU_{100}$; and (3) the fourth leg 340 of the shelf support $SU_{300}$ extends generally vertically in the Y-direction and is positioned above the second leg 220 of the shelf support $SU_{200}$. In this orientation, the first and third legs 310 and 330 of the shelf support $SU_{300}$ extend generally horizontally in the Z-direction, and the shelf support $SU_{300}$ is oriented generally parallel to the Y-Z plane. In certain embodiments, the shelf support $SU_{300}$ is attached to the stretcher $ST_{100}$ in any suitable manner, such as any of those referenced above.

The shelf support $SU_{400}$ is supported by the stretcher $ST_{200}$. More specifically, the shelf support $SU_{400}$ is positioned and oriented so: (1) the outer surface 412*o* of the first wall 412 of the first leg 410 of the shelf support $SU_{400}$ engages the outer surface 262*o* of the first wall 262 of the stretcher $ST_{200}$; (2) the second leg 420 of the shelf support $SU_{400}$ extends generally vertically in the Y-direction and is positioned above the fourth leg 240 of the shelf support $SU_{200}$; and (3) the fourth leg 440 of the shelf support $SU_{400}$ extends generally vertically in the Y-direction and is positioned above the second leg 120 of the shelf support $SU_{100}$. In this orientation, the first and third legs 410 and 430 of the shelf support $SU_{400}$ extend generally horizontally in the Z-direction, and the shelf support $SU_{400}$ is oriented generally parallel to the Y-Z plane and spaced-apart from the shelf support $SU_{300}$ in the X-direction. In certain embodiments, the shelf support $SU_{400}$ is attached to the stretcher $ST_{200}$ in any suitable manner, such as any of those referenced above.

The stretcher $ST_{300}$ is supported by and extends between and connects the shelf supports $SU_{300}$ and $SU_{400}$. More specifically, the stretcher $ST_{300}$ is positioned and oriented so: (1) the inner surface 362*i* of the first wall 360 of the stretcher $ST_{300}$ engages the outer surfaces 332*o* and 432*o* of the first walls 332 and 432 of the third legs 330 and 430 of the shelf supports $SU_{300}$ and $SU_{400}$; and (2) the inner surface 372*i* of the second wall 370 of the stretcher $ST_{300}$ engages the outer surface 322*o* of the first wall 322 of the second leg 320 of the shelf support $SU_{300}$ and the outer surface 442*o* of the first wall 442 of the fourth leg 440 of the shelf support $SU_{400}$. In this orientation, the stretcher $ST_{300}$ extends generally horizontally in the X-direction. In certain embodiments, the stretcher $ST_{300}$ is attached to the shelf supports $SU_{300}$ and $SU_{400}$ in any suitable manner, such as any of those referenced above.

The stretcher $ST_{400}$ is supported by and extends between and connects the shelf supports $SU_{300}$ and $SU_{400}$. More specifically, the stretcher $ST_{400}$ is positioned and oriented so: (1) the inner surface 462*i* of the first wall 460 of the stretcher $ST_{400}$ engages the outer surfaces 332*o* and 432*o* of the first walls 332 and 432 of the third legs 330 and 430 of the shelf supports $SU_{300}$ and $SU_{400}$; and (2) the inner surface 472*i* of the second wall 470 of the stretcher $ST_{400}$ engages the outer surface 342*o* of the first wall 342 of the fourth leg 340 of the shelf support $SU_{300}$ and the outer surface 422*o* of the first wall 422 of the second leg 420 of the shelf support $SU_{400}$. In this orientation, the stretcher $ST_{400}$ extends generally horizontally in the X-direction and is spaced apart from the stretcher $ST_{300}$ in the Z-direction. In certain embodiments, the stretcher $ST_{400}$ is attached to the shelf supports $SU_{300}$ and $SU_{400}$ in any suitable manner, such as any of those referenced above.

The shelf support $SU_{500}$ is supported by the stretcher $ST_{300}$. More specifically, the shelf support $SU_{500}$ is positioned and oriented so: (1) the outer surface 512*o* of the first wall 512 of the first leg 510 of the shelf support $SU_{500}$ engages the outer surface 362*o* of the first wall 362 of the stretcher $ST_{300}$; (2) the second leg 520 of the shelf support $SU_{500}$ extends generally vertically in the Y-direction and is positioned above the fourth leg 440 of the shelf support $SU_{400}$; and (3) the fourth leg 540 of the shelf support $SU_{500}$ extends generally vertically in the Y-direction and is positioned above the second leg 320 of the shelf support $SU_{300}$. In this orientation, the first and third legs 510 and 530 of the shelf support $SU_{500}$ extend generally horizontally in the X-direction, and the shelf support $SU_{500}$ is oriented generally parallel to the X-Y plane. In certain embodiments, the shelf support $SU_{500}$ is attached to the stretcher $ST_{300}$ in any suitable manner, such as any of those referenced above.

The shelf support $SU_{600}$ is supported by the stretcher $ST_{400}$. More specifically, the shelf support $SU_{600}$ is positioned and oriented so: (1) the outer surface 612*o* of the first wall 612 of the first leg 610 of the shelf support $SU_{600}$ engages the outer surface 462*o* of the first wall 462 of the stretcher $ST_{400}$; (2) the second leg 620 of the shelf support $SU_{600}$ extends generally vertically in the Y-direction and is positioned above the fourth leg 340 of the shelf support $SU_{300}$; and (3) the fourth leg 640 of the shelf support $SU_{600}$ extends generally vertically in the Y-direction and is positioned above the second leg 420 of the shelf support $SU_{400}$. In this orientation, the first and third legs 610 and 630 of the shelf support $SU_{600}$ extend generally horizontally in the X-direction, and the shelf support $SU_{600}$ is oriented generally parallel to the X-Y plane and spaced-apart from the shelf support $SU_{500}$ in the Z-direction. In certain embodiments, the shelf support $SU_{600}$ is attached to the stretcher $ST_{400}$ in any suitable manner, such as any of those referenced above.

The stretcher $ST_{500}$ is supported by and extends between and connects the shelf supports $SU_{500}$ and $SU_{600}$. More specifically, the stretcher $ST_{500}$ is positioned and oriented so: (1) the inner surface 562*i* of the first wall 560 of the stretcher $ST_{500}$ engages the outer surfaces 532*o* and 632*o* of the first walls 532 and 632 of the third legs 530 and 630 of the shelf supports $SU_{500}$ and $SU_{600}$; and (2) the inner surface 572*i* of the second wall 570 of the stretcher $ST_{500}$ engages the outer surface 542*o* of the first wall 542 of the fourth leg 540 of the shelf support $SU_{500}$ and engages the outer surface 622*o* of the first wall 622 of the second leg 620 of the shelf support and $SU_{600}$. In this orientation, the stretcher $ST_{500}$ extends generally horizontally in the Z-direction. In certain embodiments, the stretcher $ST_{500}$ is attached to the shelf supports $SU_{500}$ and $SU_{600}$ in any suitable manner, such as any of those referenced above.

The stretcher $ST_{600}$ is supported by and extends between and connects the shelf supports $SU_{500}$ and $SU_{600}$. More specifically, the stretcher $ST_{600}$ is positioned and oriented so: (1) the inner surface 662*i* of the first wall 660 of the stretcher $ST_{600}$ engages the outer surfaces 532*o* and 632*o* of the first walls 532 and 632 of the third legs 530 and 630 of the shelf supports $SU_{500}$ and $SU_{500}$; and (2) the inner surface 672*i* of the second wall 670 of the stretcher $ST_{600}$ engages the outer surface 522*o* of the first wall 522 of the second leg 520 of the shelf support $SU_{500}$ and engages the outer surface 642*o* of the first wall 642 of the fourth leg 640 of the shelf support $SU_{600}$. In this orientation, the stretcher $ST_{600}$ extends generally horizontally in the Z-direction and is spaced-apart from the stretcher $ST_{500}$ in the X-direction. In certain embodiments, the stretcher $ST_{600}$ is attached to the shelf supports $SU_{500}$ and $SU_{600}$ in any suitable manner, such as any of those referenced above.

The shelf support $SU_{700}$ is supported by the stretcher $ST_{500}$. More specifically, the shelf support $SU_{700}$ is positioned and oriented so: (1) the outer surface 712*o* of the first wall 712 of the first leg 710 of the shelf support $SU_{700}$ engages the outer surface 562*o* of the first wall 562 of the stretcher $ST_{500}$; (2) the second leg 720 of the shelf support $SU_{700}$ extends generally vertically in the Y-direction and is positioned above the fourth leg 540 of the shelf support $SU_{500}$; and (3) the fourth leg 740 of the shelf support $SU_{700}$ extends generally vertically in the Y-direction and is positioned above the second leg 620 of the shelf support $SU_{600}$. In this orientation, the first and third legs 710 and 730 of the shelf support $SU_{700}$ extend generally horizontally in the Z-direction, and the shelf support $SU_{700}$ is oriented generally parallel to the Y-Z plane. In certain embodiments, the shelf support $SU_{700}$ is attached to the stretcher $ST_{500}$ in any suitable manner, such as any of those referenced above.

The shelf support $SU_{800}$ is supported by the stretcher $ST_{600}$. More specifically, the shelf support $SU_{800}$ is positioned and oriented so: (1) the outer surface 812*o* of the first wall 812 of the first leg 810 of the shelf support $SU_{800}$ engages the outer surface 662*o* of the first wall 662 of the stretcher $ST_{500}$; (2) the second leg 820 of the shelf support $SU_{800}$ extends generally vertically in the Y-direction and is positioned above the fourth leg 640 of the shelf support $SU_{600}$; and (3) the fourth leg 840 of the shelf support $SU_{800}$ extends generally vertically in the Y-direction and is positioned above the second leg 520 of the shelf support $SU_{500}$. In this orientation, the first and third legs 810 and 830 of the shelf support $SU_{800}$ extend generally horizontally in the Z-direction, and the shelf support $SU_{800}$ is oriented generally parallel to the Y-Z plane and spaced-apart from the shelf support $SU_{700}$ in the X-direction. In certain embodiments, the shelf support $SU_{800}$ is attached to the stretcher $ST_{600}$ in any suitable manner, such as any of those referenced above.

The stretcher $ST_{700}$ is supported by and extends between and connects the shelf supports $SU_{700}$ and $SU_{800}$. More specifically, the stretcher $ST_{700}$ is positioned and oriented so: (1) the inner surface 762*i* of the first wall 760 of the stretcher $ST_{700}$ engages the outer surfaces 732*o* and 832*o* of the first walls 732 and 832 of the third legs 730 and 830 of the shelf supports $SU_{700}$ and $SU_{800}$; and (2) the inner surface 772*i* of the second wall 770 of the stretcher $ST_{700}$ engages the outer surface 722*o* of the first wall 722 of the second leg 720 of the shelf support $SU_{700}$ and the outer surface 842*o* of the first wall 842 of the fourth leg 840 of the shelf support $SU_{900}$. In this orientation, the stretcher $ST_{700}$ extends generally horizontally in the X-direction. In certain embodiments, the stretcher $ST_{700}$ is attached to the shelf supports $SU_{700}$ and $SU_{800}$ in any suitable manner, such as any of those referenced above.

The stretcher $ST_{800}$ is supported by and extends between and connects the shelf supports $SU_{700}$ and $SU_{800}$. More specifically, the stretcher $ST_{800}$ is positioned and oriented so: (1) the inner surface 862*i* of the first wall 860 of the stretcher $ST_{800}$ engages the outer surfaces 732*o* and 832*o* of the first walls 732 and 832 of the third legs 730 and 830 of the shelf supports $SU_{700}$ and $SU_{800}$; and (2) the inner surface 872*i* of the second wall 870 of the stretcher $ST_{800}$ engages the outer surface 742*o* of the first wall 742 of the fourth leg 740 of the shelf support $SU_{700}$ and the outer surface 822*o* of the first wall 822 of the second leg 820 of the shelf support $SU_{800}$. In this orientation, the stretcher $ST_{800}$ extends generally horizontally in the X-direction and is spaced-apart from the stretcher $ST_{700}$ in the Z-direction. In certain embodiments, the stretcher $ST_{800}$ is attached to the shelf supports $SU_{700}$ and $SU_{800}$ in any suitable manner, such as any of those referenced above.

The top support TS is positioned and oriented so the inner surfaces TS14*i* and TS34*i* of the second walls TS14 and TS34 of the legs TS10 and TS30 of the top support TS respectively engage the outer surface 762*o* of the first wall 760 of the stretcher $ST_{700}$ and the outer surface 862*o* of the first wall 860 of the stretcher $ST_{800}$. The top support TS is oriented generally parallel to the X-Z plane and spaced apart from the base support BS in the Y-direction. In certain embodiments, the top support TS is attached to stretchers $ST_{700}$ and $ST_{800}$ in any suitable manner, such as any of those referenced above.

The vertical stabilizer $V_{100}$ extends generally vertically in the Y-direction from the junction between the first and fourth legs BS10 and BS40 of the base support BS to the junction between the first and second legs TS10 and TS20 of the top support TS. The bottom of the vertical stabilizer $V_{100}$ is sandwiched between the base support BS and the shelf support $SU_{100}$, and the top of the vertical stabilizer $V_{100}$ is sandwiched between the top support TS and the stretcher $ST_{700}$. The vertical stabilizer $V_{100}$ is generally aligned with the second leg 120 of the shelf support $SU_{100}$, the fourth leg 440 of the shelf support $SU_{400}$, the second leg 520 of the shelf support $SU_{500}$, and the fourth leg 840 of the shelf support $SU_{800}$ such that the inner surfaces 162*i* and 172*i* of the first and second walls 160 and 170 of the vertical stabilizer $V_{100}$ face (and in certain embodiments engage) the legs. In certain embodiments, the vertical stabilizer $V_{100}$ is attached to one or more of these components in any suitable manner, such as any of those referenced above.

Figure 3A:
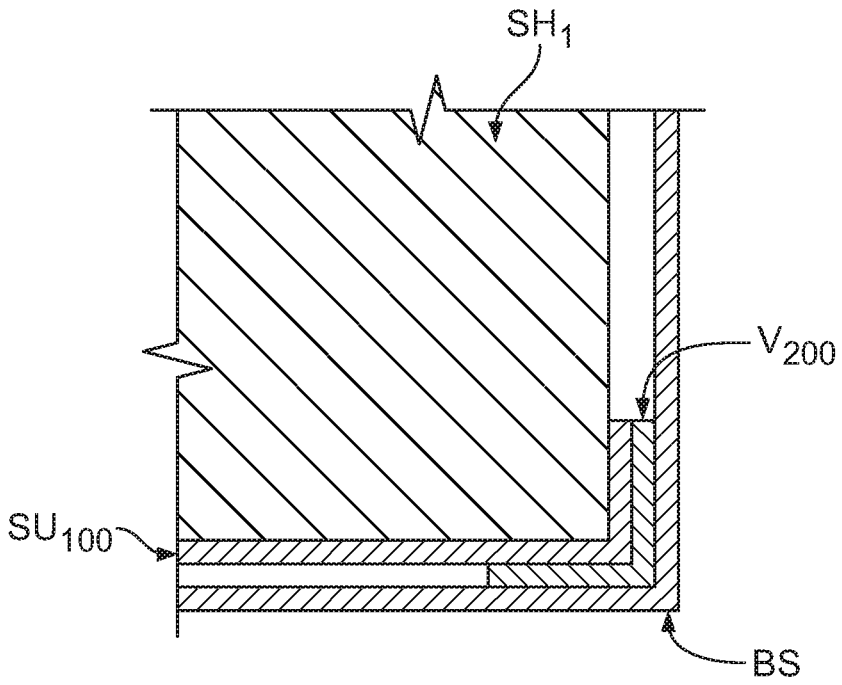
FIG. 3A is a cross-sectional top plan view of a bottom corner of the storage, shipping, and display unit of FIG. 3 taken along line 3A-3A of FIG. 3.

The vertical stabilizer $V_{200}$ extends generally vertically in the Y-direction from the junction between the first and second legs BS10 and BS20 of the base support BS to the junction between the first and fourth legs TS10 and TS40 of the top support TS. The bottom of the vertical stabilizer $V_{200}$ is sandwiched between the base support BS and the shelf support $SU_{100}$ (as shown in FIG. 3A), and the top of the vertical stabilizer $V_{200}$ is sandwiched between the top support TS and the stretcher $ST_{700}$. The vertical stabilizer $V_{200}$ is generally aligned with the fourth leg 140 of the shelf support $SU_{100}$, the second leg 320 of the shelf support $SU_{300}$, the fourth leg 540 of the shelf support $SU_{500}$, and the second leg 720 of the shelf support $SU_{700}$ such that the inner surfaces 262*i* and 272*i* of the first and second walls 260 and 270 of the vertical stabilizer $V_{200}$ face (and in certain embodiments engage) the legs. In certain embodiments, the vertical stabilizer $V_{200}$ is attached to one or more of these components in any suitable manner, such as any of those referenced above.

The vertical stabilizer $V_{300}$ extends generally vertically in the Y-direction from the junction between the second and third legs BS20 and BS30 of the base support BS to the junction between the third and fourth legs TS30 and TS40 of the top support TS. The bottom of the vertical stabilizer $V_{300}$ is sandwiched between the base support BS and the shelf support $SU_{200}$, and the top of the vertical stabilizer $V_{300}$ is sandwiched between the top support TS and the stretcher $ST_{800}$. The vertical stabilizer $V_{300}$ is generally aligned with the second leg 220 of the shelf support $SU_{200}$, the fourth leg 340 of the shelf support $SU_{300}$, the second leg 620 of the shelf support $SU_{600}$, and the fourth leg 740 of the shelf support $SU_{700}$ such that the inner surfaces 362*i* and 372*i* of the first and second walls 360 and 370 of the vertical stabilizer $V_{300}$ face (and in certain embodiments engage) the legs. In certain embodiments, the vertical stabilizer $V_{300}$ is attached to one or more of these components in any suitable manner, such as any of those referenced above.

The vertical stabilizer $V_{400}$ extends generally vertically in the Y-direction from the junction between the third and fourth legs BS30 and BS40 of the base support BS to the junction between the second and third legs TS20 and TS30 of the top support TS. The bottom of the vertical stabilizer $V_{400}$ is sandwiched between the base support BS and the shelf support $SU_{200}$, and the top of the vertical stabilizer $V_{400}$ is sandwiched between the top support TS and the stretcher $ST_{800}$. The vertical stabilizer $V_{400}$ is generally aligned with the fourth leg 240 of the shelf support $SU_{200}$, the second leg 420 of the shelf support $SU_{400}$, the fourth leg 640 of the shelf support $SU_{600}$, and the second leg 820 of the shelf support $SU_{800}$ such that the inner surfaces 462*i* and 472*i* of the first and second walls 460 and 470 of the vertical stabilizer $V_{400}$ face (and in certain embodiments engage) the legs. In certain embodiments, the vertical stabilizer $V_{400}$ is attached to one or more of these components in any suitable manner, such as any of those referenced above.

The shelves $SH_1$-$SH_4$ are rectangular cuboid in shape and are formed from any suitable material or materials. In this example embodiment, the shelves include opposing top and bottom facing layers of paper or corrugated material that sandwich core material in between (such as honeycomb material. In other embodiments, the shelves may be formed from any suitable material, such as built-up corrugated material or plastic.

The shelf $SH_1$ extends between and is supported by the shelf supports $SU_{100}$ and $SU_{200}$. Specifically, the bottom surface of the shelf $SH_1$ engages the inner surfaces 112*i* and 212*i* of the first walls 112 and 212 of the first legs 110 and 210 of the shelf supports $SU_{100}$ and $SU_{200}$ so the shelf $SH_1$ is oriented generally parallel to the X-Z plane. The shelf $SH_1$ is sized and shaped so installing the shelf $SH_1$ forces the shelf supports $SU_{100}$ and $SU_{200}$ away from one another against the vertical stabilizers $V_{100}$-$V_{400}$, which in turn forces the vertical stabilizers $V_{100}$-$V_{400}$ against the base support BS. This adds rigidity to the storage, shipping, and display unit E1 and ensures the shelf $SH_1$ is held in place via interference fit. The walls of the first, second, and fourth legs of the shelf supports $SU_{100}$ and $SU_{200}$ prevent substantial back-and-forth and side-to-side movement of the shelf $SH_1$ in the X- and Z-directions relative to the other components of the storage, shipping, and display unit E1. In certain embodiments, the shelf $SH_1$ is attached to one or more of the shelf supports $SU_{100}$ and $SU_{200}$ in any suitable manner, such as any of those referenced above.

The shelf $SH_2$ extends between and is supported by the shelf supports $SU_{300}$ and $SU_{400}$. Specifically, the bottom surface of the shelf $SH_2$ engages the inner surfaces 312*i* and 412*i* of the first walls 312 and 412 of the first legs 310 and 410 of the shelf supports $SU_{300}$ and $SU_{400}$ so the shelf $SH_2$ is oriented generally parallel to the X-Z plane. The shelf $SH_2$ is sized and shaped so installing the shelf $SH_2$ forces the shelf supports $SU_{300}$ and $SU_{400}$ away from one another and against the vertical stabilizers $V_{100}$-$V_{400}$. This adds rigidity to the storage, shipping, and display unit E1 and ensures the shelf $SH_2$ is held in place via interference fit. The walls of the first, second, and fourth legs of the shelf supports $SU_{300}$ and $SU_{400}$ prevent substantial back-and-forth and side-to-side movement of the shelf $SH_2$ in the X- and Z-directions relative to the other components of the storage, shipping, and display unit E1. In certain embodiments, the shelf $SH_2$ is attached to one or more of the shelf supports $SU_{300}$ and $SU_{400}$ in any suitable manner, such as any of those referenced above.

The shelf $SH_3$ extends between and is supported by the shelf supports $SU_{500}$ and $SU_{600}$. Specifically, the bottom surface of the shelf $SH_3$ engages the inner surfaces 512*i* and 612*i* of the first walls 512 and 612 of the first legs 510 and 610 of the shelf supports $SU_{500}$ and $SU_{600}$ so the shelf $SH_3$ is oriented generally parallel to the X-Z plane. The shelf $SH_3$ is sized and shaped so installing the shelf $SH_3$ forces the shelf supports $SU_{500}$ and $SU_{600}$ away from one another and against the vertical stabilizers $V_{100}$-$V_{400}$. This adds rigidity to the storage, shipping, and display unit E1 and ensures the shelf $SH_3$ is held in place via interference fit. The walls of the first, second, and fourth legs of the shelf supports $SU_{500}$ and $SU_{600}$ prevent substantial back-and-forth and side-to-side movement of the shelf $SH_3$ in the X- and Z-directions relative to the other components of the storage, shipping, and display unit E1. In certain embodiments, the shelf $SH_3$ is attached to one or more of the shelf supports $SU_{500}$ and $SU_{600}$ in any suitable manner, such as any of those referenced above.

The shelf $SH_4$ extends between and is supported by the shelf supports $SU_{700}$ and $SU_{800}$. Specifically, the bottom surface of the shelf $SH_4$ engages the inner surfaces 712*i* and 812*i* of the first walls 712 and 812 of the first legs 710 and 810 of the shelf supports $SU_{700}$ and $SU_{800}$ so the shelf $SH_4$ is oriented generally parallel to the X-Z plane. The shelf $SH_4$ is sized and shaped so installing the shelf $SH_4$ forces the shelf supports $SU_{700}$ and $SU_{800}$ away from one another and against the vertical stabilizers $V_{100}$-$V_{400}$, which in turn forces the vertical stabilizers $V_{100}$-$V_{400}$ against the top support TS. This adds rigidity to the storage, shipping, and display unit E1 and ensures the shelf $SH_4$ is held in place via interference fit. The walls of the first, second, and fourth legs of the shelf supports $SU_{700}$ and $SU_{800}$ prevent substantial back-and-forth and side-to-side movement of the shelf $SH_4$ in the X- and Z-directions relative to the other components of the storage, shipping, and display unit E1. In certain embodiments, the shelf $SH_4$ is attached to one or more of the shelf supports $SU_{700}$ and $SU_{800}$ in any suitable manner, such as any of those referenced above.

The height $H_{E1}$ of the storage, shipping, and display unit E1 is generally equal to the sum of the lengths of the vertically aligned legs of the shelf supports. The width $W_{E1}$ of the storage, shipping, and display unit E1 is generally equal to the lengths of the first and third legs of the shelf supports $SU_{100}$, $SU_{200}$, $SU_{500}$, and $SU_{600}$ and the lengths of the stretchers $ST_{300}$, $ST_{400}$, $ST_{700}$, and $ST_{800}$. The depth $D_{E1}$ of the storage, shipping, and display unit E1 is generally equal to the lengths of the first and third legs of the shelf supports $SU_{300}$, $SU_{400}$, $SU_{700}$, and $SU_{800}$ and the lengths of the stretchers $ST_{100}$, $ST_{200}$, $ST_{500}$, and $ST_{600}$.

The storage, shipping, and display unit of the present disclosure solves the above-described problems. A vendor can assemble the storage, shipping, and display unit; load its product directly onto the storage, shipping, and display unit; and ship the storage, shipping, and display unit to the retailer. After receiving the storage, shipping, and display unit (loaded with products), the retailer moves it onto the sales floor. The storage, shipping, and display unit thus acts as a storage unit, shipping container, and display unit for the products. This eliminates excess packaging for the products, thereby lowering shipping costs and reducing waste. This eliminates the need for retailers to transfer the products from their packaging to display units, which saves time and reduces labor costs. This eliminates the need for retailers to purchase, store, set up, and take down reusable display units, which saves time and money. In instances in which the storage, shipping, and display unit is formed from components made of recyclable material, the reduced weight of the display unit reduces freight costs and therefore increases the shipping radius of the display unit. Yet the construction of the display unit renders it rigid so as not to sacrifice performance. It also reduces the cost of the display unit and, since the display unit is recyclable, enables the retailer to recycle the display unit after use rather than ship it back to the vendor.

In other embodiments, some or all of the stretchers nest into and are supported by the shelf supports. In certain of these embodiments, the shelf supports directly contact and directly support one another, and the stretchers directly contact and directly support the shelves while providing rigidity to the frame. For instance, in one of these embodiments, the stretcher $ST_{100}$ nests within one of the legs of the shelf support $SU_{300}$ such that the shelf supports $SU_{100}$ and $SU_{200}$ directly contact and directly support that leg of the shelf support $SU_{300}$.

Figure 6:
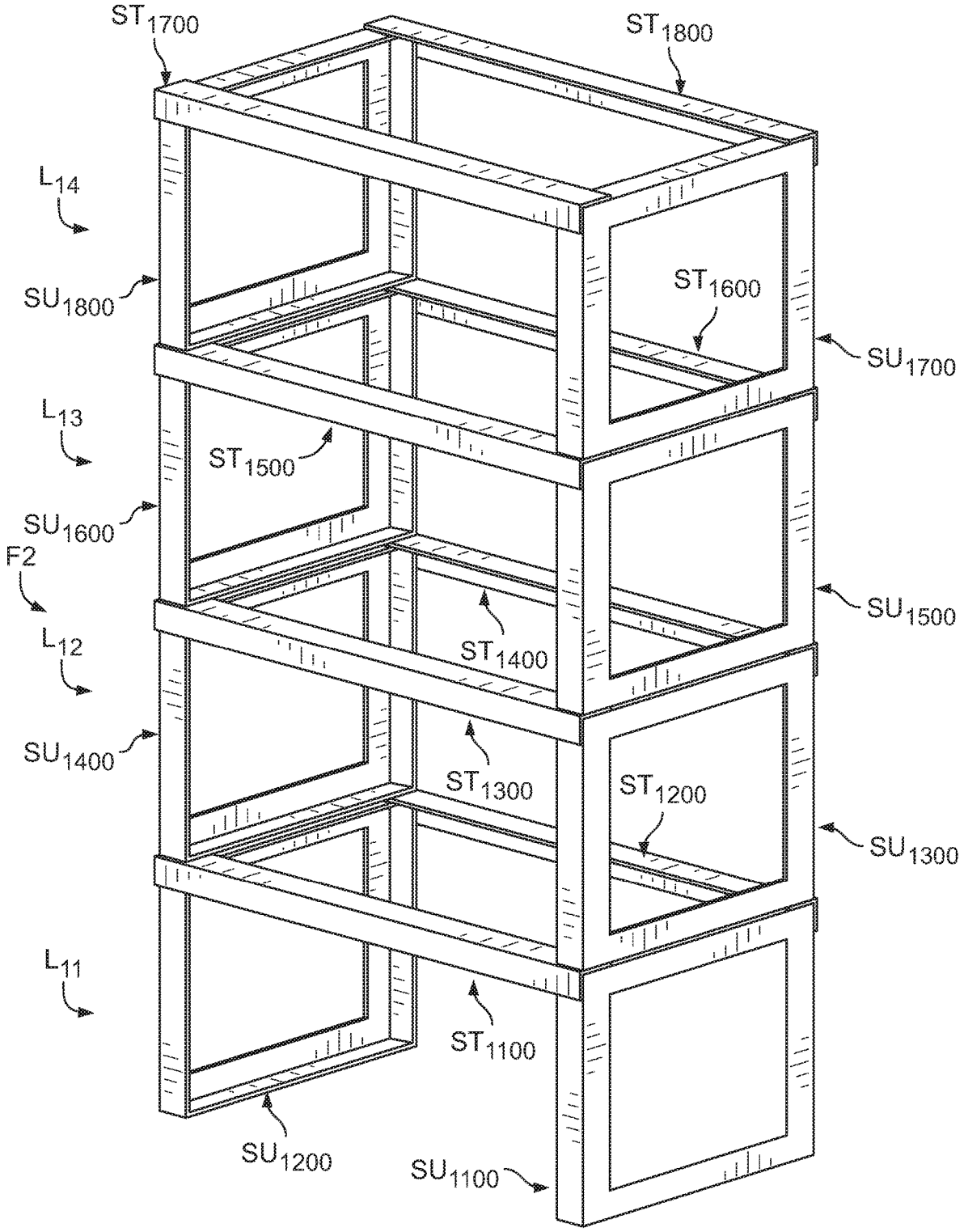
FIGS. 6 and 7 are assembled and exploded perspective views, respectively, of the frame of another embodiment of the storage, shipping, and display unit of the present disclosure.
Figure 7:
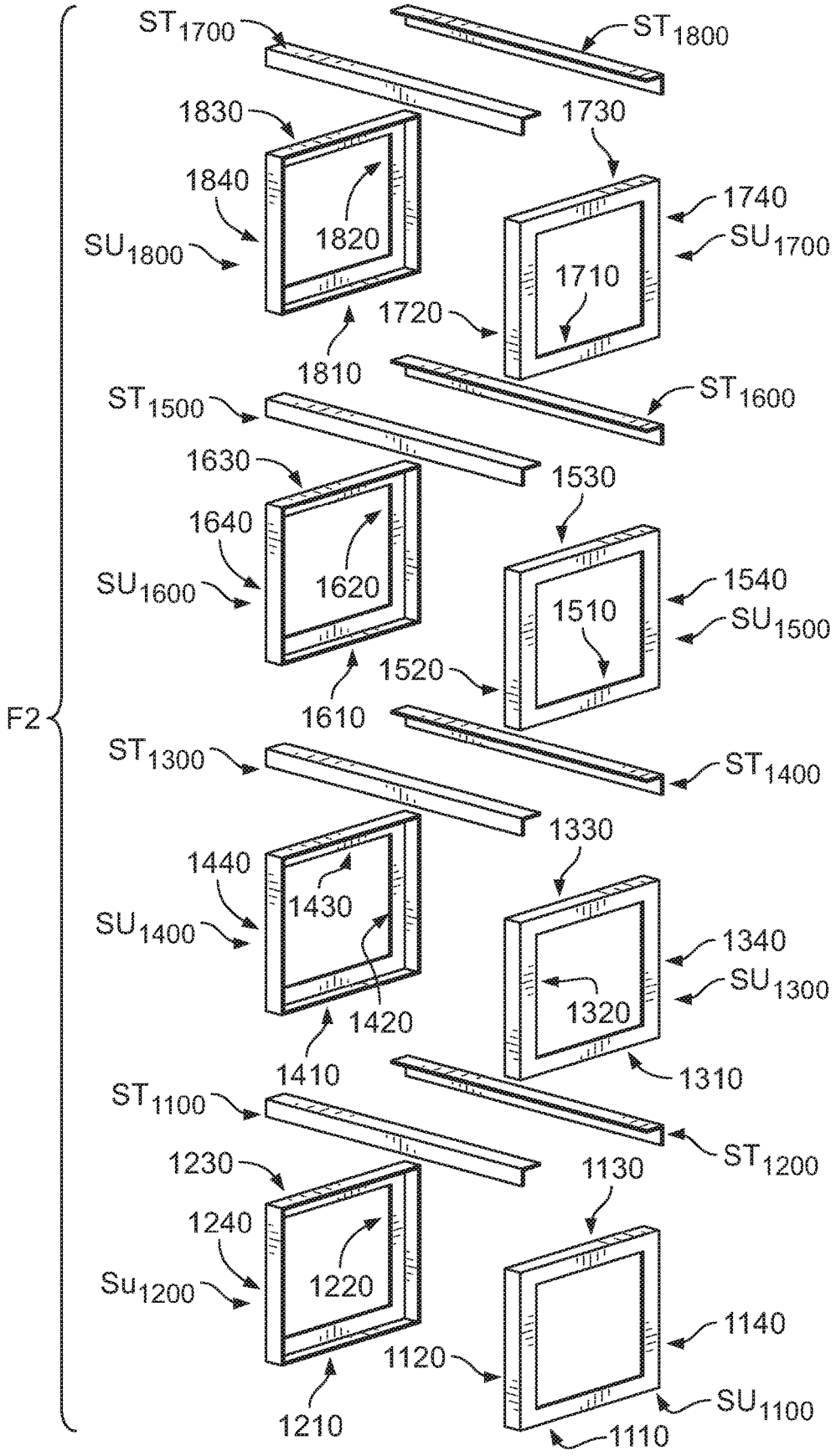

FIGS. 6 and 7 show the frame F2 of another embodiment of the storage, shipping, and display unit. While not shown, this embodiment of the storage, shipping, and display unit includes the same base support, top support, vertical stabilizers, and shelves as the storage, shipping, and display unit E1 shown in FIG. 3. The frame F2 includes shelf supports $SU_{1100}$, $SU_{1200}$, $SU_{1300}$, $SU_{1400}$, $SU_{1500}$, $SU_{1600}$, $SU_{1700}$, and $SU_{1800}$ and stretchers $ST_{1100}$, $ST_{1200}$, $ST_{1300}$, $ST_{1400}$, $ST_{1500}$, $ST_{1600}$, $ST_{1700}$, and $ST_{1800}$. In this example embodiment, the shelf supports $SU_{1100}$-$SU_{1800}$ are the same size and shape, and the stretchers $ST_{1100}$-$ST_{1800}$ are the same size and shape.

The frame F2 is formed of multiple frame layers $L_{11}$, $L_{12}$, $L_{13}$, and $L_{14}$, each of which includes a spaced-apart pair of the shelf supports $SU_{1100}$-$SU_{1800}$ that together support one of the shelves (not shown). A pair of the stretchers $ST_{1100}$-$ST_{1800}$ separates consecutive frame layers. In this example embodiment, the pairs of shelf supports are oriented parallel to the pair(s) of shelf supports in the frame layers above and below that given frame layer. Put differently, in this example embodiment the pairs of shelf supports have the same orientation from frame layer to frame layer.

The orientations of the components of the frame F2 are described below with respect to the coordinate system C shown in FIG. 3. For clarity, the supports are showed in simplified form in the drawings, though they are generally the same as the support SU shown in FIGS. 1A and 1B.

The shelf supports $SU_{1100}$ and $SU_{1200}$ are oriented generally parallel to the Y-Z plane and are spaced-apart in the X-direction. The shelf support $SU_{1100}$ is positioned and oriented so its second and fourth legs 1120 and 1140 extend generally vertically in the Y-direction and so its first and third legs 1110 and 1130 extend generally horizontally in the Z-direction. The shelf support $SU_{1200}$ is positioned and oriented so its second and fourth legs 1220 and 1240 extend generally vertically in the Y-direction and so its first and third legs 1210 and 1230 extend generally horizontally in the Z-direction.

The stretcher $ST_{1100}$ is supported by and extends between and connects the shelf supports $SU_{1100}$ and $SU_{1200}$. More specifically, the stretcher $ST_{1100}$ is positioned with one end above the second leg 1120 of the shelf support $SU_{1100}$ and the other end above the fourth leg 1240 of the shelf support $SU_{1200}$. The stretcher $ST_{1100}$ extends generally horizontally in the X-direction. In certain embodiments, the stretcher $ST_{1100}$ is attached to the shelf supports $SU_{1100}$ and $SU_{1200}$ in any suitable manner, such as any of those referenced above.

The stretcher $ST_{1200}$ is supported by and extends between and connects the shelf supports $SU_{1100}$ and $SU_{1200}$. More specifically, the stretcher $ST_{1200}$ is spaced-apart from the stretcher $ST_{1100}$ in the Z-direction and positioned with one end above the fourth leg 1140 of the shelf support $SU_{1100}$ and the other end above the second leg 1220 of the shelf support $SU_{1200}$. The stretcher $ST_{1200}$ extends generally horizontally in the X-direction. In certain embodiments, the stretcher $ST_{1200}$ is attached to the shelf supports $SU_{1100}$ and $SU_{1200}$ in any suitable manner, such as any of those referenced above.

The shelf support $SU_{1300}$ is supported by the stretchers $ST_{1100}$ and $ST_{1200}$. More specifically, the shelf support $SU_{1300}$ is positioned and oriented so the second leg 1320 of the shelf support $SU_{1300}$ extends generally vertically in the Y-direction and is positioned above the second leg 1120 of the shelf support $SU_{1100}$ and the fourth leg 1340 of the shelf support $SU_{1300}$ extends generally vertically in the Y-direction and is positioned above the fourth leg 1140 of the shelf support $SU_{1100}$. In this orientation, the first and third legs 1310 and 1330 of the shelf support $SU_{1300}$ extend generally horizontally in the Z-direction, and the shelf support $SU_{1300}$ is oriented generally parallel to the Y-Z plane. In certain embodiments, the shelf support $SU_{1300}$ is attached to one or more of stretchers $ST_{1100}$ and $ST_{1200}$ in any suitable manner, such as any of those referenced above.

The shelf support $SU_{1400}$ is supported by the stretchers $ST_{1100}$ and $ST_{1200}$. More specifically, the shelf support $SU_{1400}$ is positioned and oriented so the second leg 1420 of the shelf support $SU_{1400}$ extends generally vertically in the Y-direction and is positioned above the second leg 1220 of the shelf support $SU_{1200}$ and the fourth leg 1440 of the shelf support $SU_{1400}$ extends generally vertically in the Y-direction and is positioned above the fourth leg 1240 of the shelf support $SU_{1200}$ In this orientation, the first and third legs 1410 and 1430 of the shelf support $SU_{1400}$ extend generally horizontally in the Z-direction, and the shelf support $SU_{1400}$ is oriented generally parallel to the Y-Z plane. In certain embodiments, the shelf support $SU_{1400}$ is attached to one or more of stretchers $ST_{1100}$ and $ST_{1200}$ in any suitable manner, such as any of those referenced above.

The stretcher $ST_{1300}$ is supported by and extends between and connects the shelf supports $SU_{1300}$ and $SU_{1400}$. More specifically, the stretcher $ST_{1300}$ is positioned with one end above the second leg 1320 of the shelf support $SU_{1300}$ and the other end above the fourth leg 1440 of the shelf support $SU_{1400}$. The stretcher $ST_{1300}$ extends generally horizontally in the X-direction. In certain embodiments, the stretcher $ST_{1300}$ is attached to the shelf supports $SU_{1300}$ and $SU_{1400}$ in any suitable manner, such as any of those referenced above.

The stretcher $ST_{1400}$ is supported by and extends between and connects the shelf supports $SU_{1300}$ and $SU_{1400}$. More specifically, the stretcher $ST_{1400}$ is spaced-apart from the stretcher $ST_{1300}$ in the Z-direction and positioned with one end above the fourth leg 1340 of the shelf support $SU_{1300}$ and the other end above the second leg 1420 of the shelf support $SU_{1400}$. The stretcher $ST_{1400}$ extends generally horizontally in the X-direction. In certain embodiments, the stretcher $ST_{1400}$ is attached to the shelf supports $SU_{1300}$ and $SU_{1400}$ in any suitable manner, such as any of those referenced above.

The shelf support $SU_{1500}$ is supported by the stretchers $ST_{1300}$ and $ST_{1400}$. More specifically, the shelf support $SU_{1500}$ is positioned and oriented so the second leg 1520 of the shelf support $SU_{1500}$ extends generally vertically in the Y-direction and is positioned above the second leg 1320 of the shelf support $SU_{1300}$ and the fourth leg 1540 of the shelf support $SU_{1500}$ extends generally vertically in the Y-direction and is positioned above the fourth leg 1340 of the shelf support $SU_{1300}$ In this orientation, the first and third legs 1510 and 1530 of the shelf support $SU_{1500}$ extend generally horizontally in the Z-direction, and the shelf support $SU_{1500}$ is oriented generally parallel to the Y-Z plane. In certain embodiments, the shelf support $SU_{1500}$ is attached to one or more of stretchers $ST_{1300}$ and $ST_{1400}$ in any suitable manner, such as any of those referenced above.

The shelf support $SU_{1600}$ is supported by the stretchers $ST_{1300}$ and $ST_{1400}$. More specifically, the shelf support $SU_{1600}$ is positioned and oriented so the second leg 1620 of the shelf support $SU_{1600}$ extends generally vertically in the Y-direction and is positioned above the second leg 1420 of the shelf support $SU_{1400}$ and the fourth leg 1640 of the shelf support $SU_{1600}$ extends generally vertically in the Y-direction and is positioned above the fourth leg 1440 of the shelf support $SU_{1400}$ In this orientation, the first and third legs 1610 and 1630 of the shelf support $SU_{1600}$ extend generally horizontally in the Z-direction, and the shelf support $SU_{1600}$ is oriented generally parallel to the Y-Z plane. In certain embodiments, the shelf support $SU_{1600}$ is attached to one or more of stretchers $ST_{1300}$ and $S_{1500}$ in any suitable manner, such as any of those referenced above.

The stretcher $ST_{1500}$ is supported by and extends between and connects the shelf supports $SU_{1500}$ and $SU_{1600}$. More specifically, the stretcher $ST_{1500}$ is positioned with one end above the second leg 1520 of the shelf support $SU_{1500}$ and the other end above the fourth leg 1640 of the shelf support $SU_{1600}$. The stretcher $ST_{1500}$ extends generally horizontally in the X-direction. In certain embodiments, the stretcher $ST_{1500}$ is attached to the shelf supports $SU_{1500}$ and $SU_{1600}$ in any suitable manner, such as any of those referenced above.

The stretcher $ST_{1600}$ is supported by and extends between and connects the shelf supports $SU_{1500}$ and $SU_{1600}$. More specifically, the stretcher $ST_{1600}$ is spaced-apart from the stretcher $ST_{1500}$ in the Z-direction and positioned with one end above the fourth leg 1540 of the shelf support $SU_{1500}$ and the other end above the second leg 1620 of the shelf support $SU_{1600}$. The stretcher $ST_{1600}$ extends generally horizontally in the X-direction. In certain embodiments, the stretcher $ST_{1600}$ is attached to the shelf supports $SU_{1500}$ and $SU_{1600}$ in any suitable manner, such as any of those referenced above.

The shelf support $SU_{1700}$ is supported by the stretchers $ST_{1500}$ and $ST_{1600}$. More specifically, the shelf support $SU_{1700}$ is positioned and oriented so the second leg 1720 of the shelf support $SU_{1700}$ extends generally vertically in the Y-direction and is positioned above the second leg 1520 of the shelf support $SU_{1500}$ and the fourth leg 1740 of the shelf support $SU_{1700}$ extends generally vertically in the Y-direction and is positioned above the fourth leg 1540 of the shelf support $SU_{1500}$. In this orientation, the first and third legs 1710 and 1730 of the shelf support $SU_{1700}$ extend generally horizontally in the Z-direction, and the shelf support $SU_{1700}$ is oriented generally parallel to the Y-Z plane. In certain embodiments, the shelf support $SU_{1700}$ is attached to one or more of stretchers $ST_{1500}$ and $ST_{1600}$ in any suitable manner, such as any of those referenced above.

The shelf support $SU_{1800}$ is supported by the stretchers $ST_{1500}$ and $ST_{1600}$. More specifically, the shelf support $SU_{1800}$ is positioned and oriented so the second leg 1820 of the shelf support $SU_{1800}$ extends generally vertically in the Y-direction and is positioned above the second leg 1620 of the shelf support $SU_{1600}$ and the fourth leg 1840 of the shelf support $SU_{1800}$ extends generally vertically in the Y-direction and is positioned above the fourth leg 1640 of the shelf support $SU_{1600}$ In this orientation, the first and third legs 1810 and 1830 of the shelf support $SU_{1800}$ extend generally horizontally in the Z-direction, and the shelf support $SU_{1800}$ is oriented generally parallel to the Y-Z plane. In certain embodiments, the shelf support $SU_{1800}$ is attached to one or more of stretchers $ST_{1500}$ and $ST_{1600}$ in any suitable manner, such as any of those referenced above.

The stretcher $ST_{1700}$ is supported by and extends between and connects the shelf supports $SU_{1700}$ and $SU_{1800}$. More specifically, the stretcher $ST_{1700}$ is positioned with one end above the second leg 1720 of the shelf support $SU_{1700}$ and the other end above the fourth leg 1840 of the shelf support $SU_{1800}$. The stretcher $ST_{1700}$ extends generally horizontally in the X-direction. In certain embodiments, the stretcher $ST_{1700}$ is attached to the shelf supports $SU_{1700}$ and $SU_{1800}$ in any suitable manner, such as any of those referenced above.

The stretcher $ST_{1800}$ is supported by and extends between and connects the shelf supports $SU_{1700}$ and $SU_{1800}$. More specifically, the stretcher $ST_{1800}$ is spaced-apart from the stretcher $ST_{1700}$ in the Z-direction and positioned with one end above the fourth leg 1740 of the shelf support $SU_{1700}$ and the other end above the second leg 1820 of the shelf support $SU_{1800}$. The stretcher $ST_{1800}$ extends generally horizontally in the X-direction. In certain embodiments, the stretcher $ST_{1800}$ is attached to the shelf supports $SU_{1700}$ and $SU_{1800}$ in any suitable manner, such as any of those referenced above.

The height (not labeled) of this embodiment of the storage, shipping, and display unit is generally equal to the sum of the lengths of the vertically aligned legs of the shelf supports. The width (not labeled) of this embodiment of the storage, shipping, and display unit is generally equal to the lengths of the stretchers $ST_{1100}$-$ST_{1800}$. The depth (not labeled) of this embodiment of the storage, shipping, and display unit is generally equal to the lengths of the first and third legs of the shelf supports $SU_{1100}$-$SU_{1800}$.

In other embodiments, some or all of the stretchers nest into and are supported by the shelf supports. In certain of these embodiments, the shelf supports directly contact and directly support one another, and the stretchers directly contact and directly support the shelves while providing rigidity to the frame. For instance, in one of these embodiments, the stretcher $ST_{1100}$ nests within and extends between the legs of the shelf supports $SU_{1300}$ and $SU_{1400}$ such that the shelf supports $SU_{1100}$ and $SU_{1200}$ directly contact and directly support those legs of the shelf supports $SU_{1300}$ and $SU_{1400}$.

Figure 8:
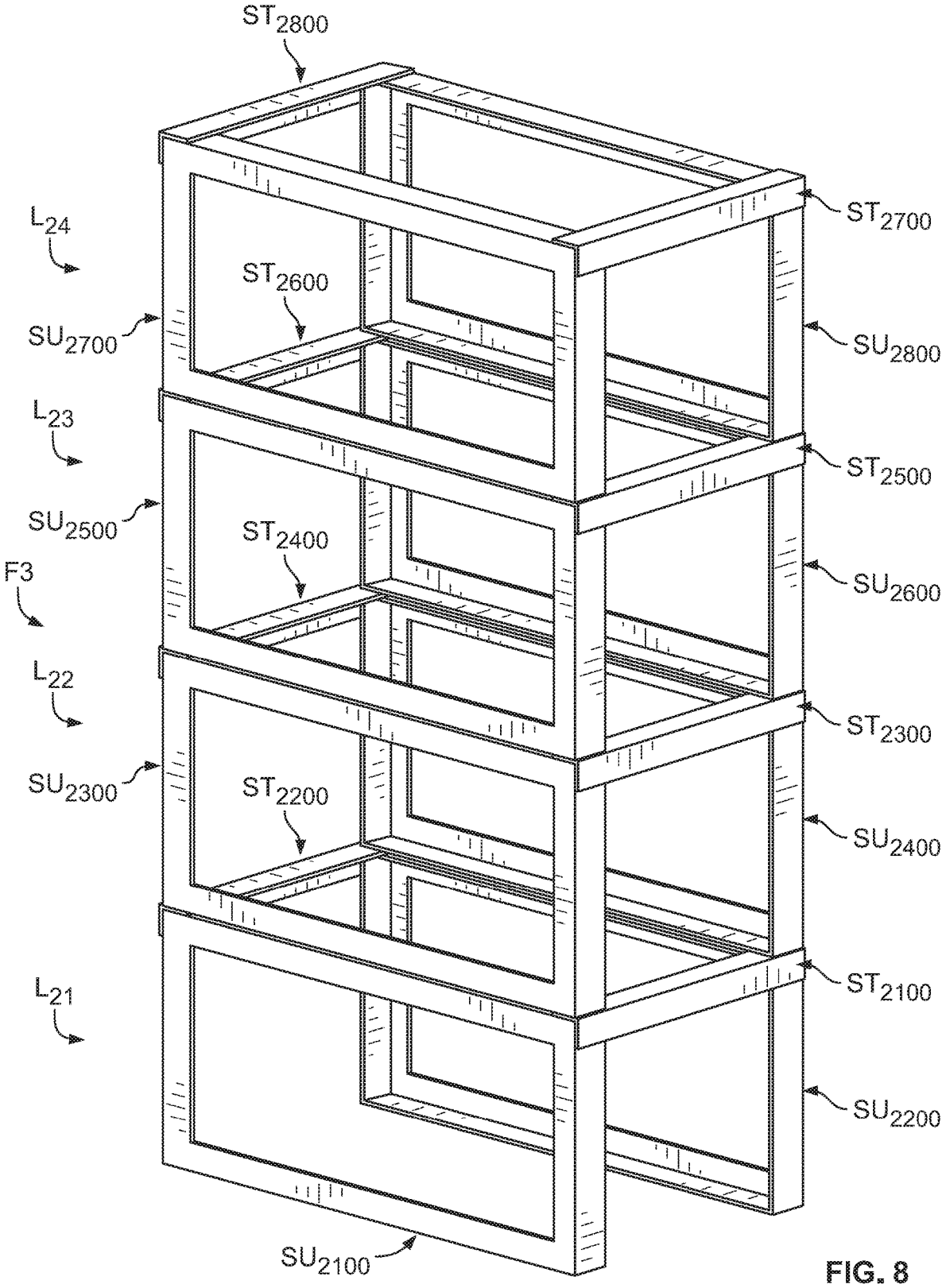
FIGS. 8 and 9 are assembled and exploded perspective views, respectively, of the frame of another embodiment of the storage, shipping, and display unit of the present disclosure.
Figure 9:
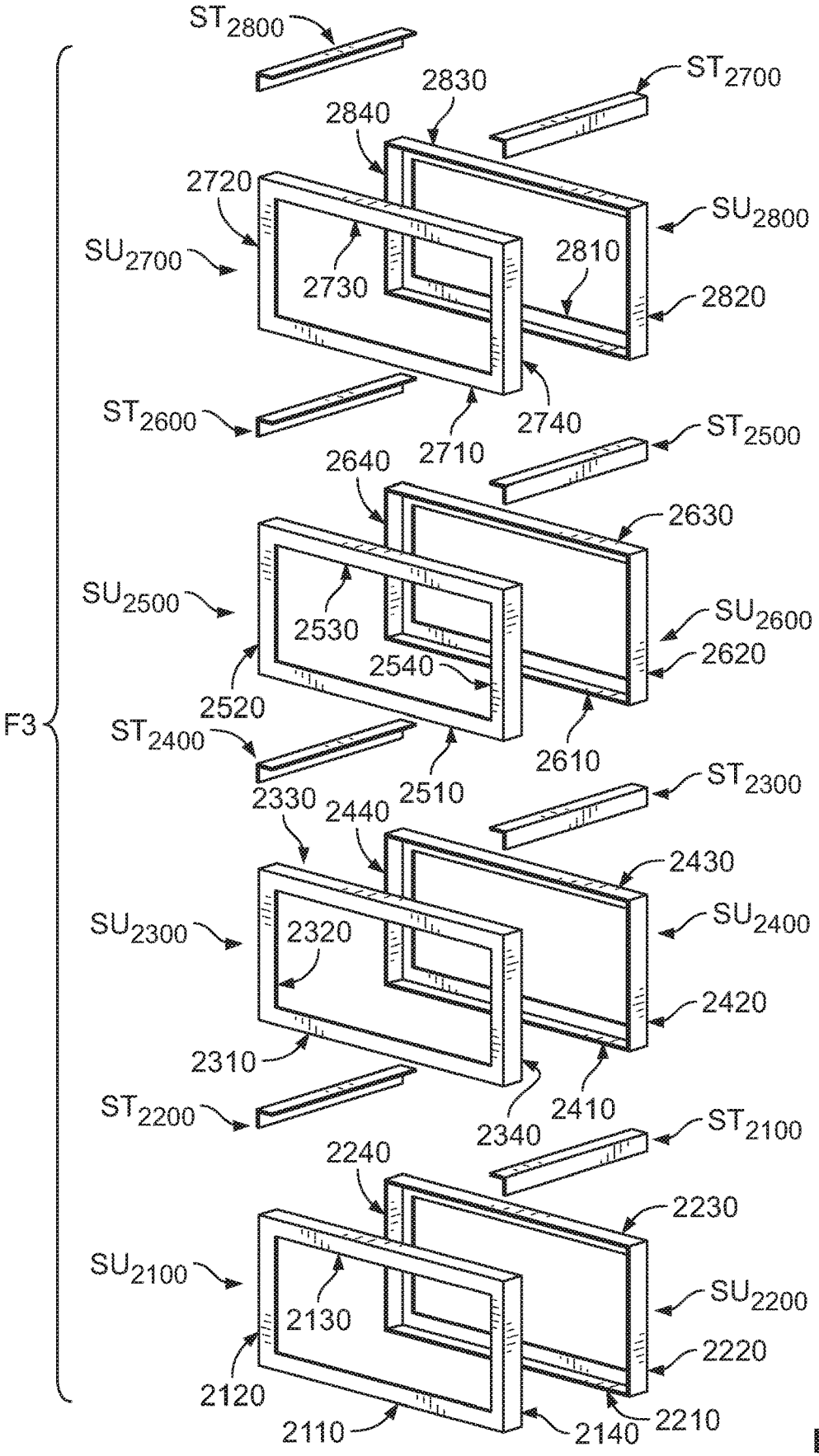

FIGS. 8 and 9 show the frame F3 of another embodiment of the storage, shipping, and display unit. While not shown, this embodiment of the storage, shipping, and display unit includes the same base support, top support, vertical stabilizers, and shelves as the storage, shipping, and display unit E1 shown in FIG. 3. The frame F3 includes shelf supports $SU_{2100}$, $SU_{2200}$, $SU_{2300}$, $SU_{2400}$, $SU_{2500}$, $SU_{2600}$, $SU_{2700}$, and $SU_{2800}$ and stretchers $ST_{2100}$, $ST_{2200}$, $ST_{2300}$, $ST_{2400}$, $ST_{2500}$, $ST_{2600}$, $ST_{2700}$, and $ST_{2800}$. In this example embodiment, the shelf supports $SU_{2100}$-$SU_{2800}$ are the same size and shape, and the stretchers $ST_{2100}$-$ST_{2800}$ are the same size and shape.

The frame F3 is formed of multiple frame layers $L_{21}$, $L_{22}$, $L_{23}$, and $L_{24}$, each of which includes a spaced-apart pair of the shelf supports $SU_{2100}$-$SU_{2800}$ that together support one of the shelves (not shown). A pair of the stretchers $ST_{2100}$-$ST_{2800}$ separates consecutive frame layers. In this example embodiment, the pairs of shelf supports are oriented parallel to the pair(s) of shelf supports in the frame layers above and below that given frame layer. Put differently, in this example embodiment the pairs of shelf supports have the same orientation from frame layer to frame layer.

The orientations of the components of the frame F3 are described below with respect to the coordinate system C shown in FIG. 3. For clarity, the supports are showed in simplified form in the drawings, though they are generally the same as the support SU shown in FIGS. 1A and 1B.

The shelf supports $SU_{2100}$ and $SU_{2200}$ are oriented generally parallel to the X-Y plane and are spaced-apart in the Z-direction. The shelf support $SU_{2100}$ is positioned and oriented so its second and fourth legs 2120 and 2140 extend generally vertically in the Y-direction and so its first and third legs 2110 and 2130 extend generally horizontally in the X-direction. The shelf support $SU_{2200}$ is positioned and oriented so its second and fourth legs 2220 and 2240 extend generally vertically in the Y-direction and so its first and third legs 2210 and 2230 extend generally horizontally in the X-direction.

The stretcher $ST_{2100}$ is supported by and extends between and connects the shelf supports $SU_{2100}$ and $SU_{2200}$. More specifically, the stretcher $ST_{2100}$ is positioned with one end above the fourth leg 2140 of the shelf support $SU_{2100}$ and the other end above the second leg 2220 of the shelf support $SU_{2200}$. The stretcher $ST_{2100}$ extends generally horizontally in the Z-direction. In certain embodiments, the stretcher $ST_{2100}$ is attached to the shelf supports $SU_{2100}$ and $SU_{2200}$ in any suitable manner, such as any of those referenced above.

The stretcher $ST_{2200}$ is supported by and extends between and connects the shelf supports $SU_{2100}$ and $SU_{2200}$. More specifically, the stretcher $ST_{2200}$ is spaced-apart from the stretcher $ST_{2100}$ in the X-direction and positioned with one end above the second leg 2120 of the shelf support $SU_{2100}$ and the other end above the fourth leg 2240 of the shelf support $SU_{2200}$. The stretcher $ST_{2200}$ extends generally horizontally in the Z-direction. In certain embodiments, the stretcher $ST_{2200}$ is attached to the shelf supports $SU_{2100}$ and $SU_{2200}$ in any suitable manner, such as any of those referenced above.

The shelf support $SU_{2300}$ is supported by the stretchers $ST_{2100}$ and $ST_{2200}$. More specifically, the shelf support $SU_{2300}$ is positioned and oriented so the second leg 2320 of the shelf support $SU_{2300}$ extends generally vertically in the Y-direction and is positioned above the second leg 2120 of the shelf support $SU_{2100}$ and the fourth leg 2340 of the shelf support $SU_{2300}$ extends generally vertically in the Y-direction and is positioned above the fourth leg 2140 of the shelf support $SU_{2100}$. In this orientation, the first and third legs 2310 and 2330 of the shelf support $SU_{2300}$ extend generally horizontally in the X-direction, and the shelf support $SU_{2300}$ is oriented generally parallel to the X-Y plane. In certain embodiments, the shelf support $SU_{2300}$ is attached to one or more of stretchers $ST_{2100}$ and $ST_{2200}$ in any suitable manner, such as any of those referenced above.

The shelf support $SU_{2400}$ is supported by the stretchers $ST_{2100}$ and $ST_{2200}$. More specifically, the shelf support $SU_{2400}$ is positioned and oriented so the second leg 2420 of the shelf support $SU_{2400}$ extends generally vertically in the Y-direction and is positioned above the second leg 2220 of the shelf support $SU_{2200}$ and the fourth leg 2440 of the shelf support $SU_{2400}$ extends generally vertically in the Y-direction and is positioned above the fourth leg 2240 of the shelf support $SU_{2200}$. In this orientation, the first and third legs 2410 and 2430 of the shelf support $SU_{2400}$ extend generally horizontally in the X-direction, and the shelf support $SU_{2400}$ is oriented generally parallel to the X-Y plane. In certain embodiments, the shelf support $SU_{2400}$ is attached to one or more of stretchers $ST_{2100}$ and $ST_{2200}$ in any suitable manner, such as any of those referenced above.

The stretcher $ST_{2300}$ is supported by and extends between and connects the shelf supports $SU_{2300}$ and $SU_{2400}$. More specifically, the stretcher $ST_{2300}$ is positioned with one end above the fourth leg 2440 of the shelf support $SU_{2300}$ and the other end above the second leg 2420 of the shelf support $SU_{2400}$. The stretcher $ST_{2300}$ extends generally horizontally in the Z-direction. In certain embodiments, the stretcher $ST_{2300}$ is attached to the shelf supports $SU_{2300}$ and $SU_{2400}$ in any suitable manner, such as any of those referenced above.

The stretcher $ST_{2400}$ is supported by and extends between and connects the shelf supports $SU_{2300}$ and $SU_{2400}$. More specifically, the stretcher $ST_{2400}$ is spaced-apart from the stretcher $ST_{2300}$ in the X-direction and positioned with one end above the second leg 2320 of the shelf support $SU_{2300}$ and the other end above the fourth leg 2440 of the shelf support $SU_{2400}$. The stretcher $ST_{2400}$ extends generally horizontally in the Z-direction. In certain embodiments, the stretcher $ST_{2400}$ is attached to the shelf supports $SU_{2300}$ and $SU_{2400}$ in any suitable manner, such as any of those referenced above.

The shelf support $SU_{2500}$ is supported by the stretchers $ST_{2300}$ and $ST_{2400}$. More specifically, the shelf support $SU_{2500}$ is positioned and oriented so the second leg 2520 of the shelf support $SU_{2500}$ extends generally vertically in the Y-direction and is positioned above the second leg 2320 of the shelf support $SU_{2300}$ and the fourth leg 2540 of the shelf support $SU_{2500}$ extends generally vertically in the Y-direction and is positioned above the fourth leg 2340 of the shelf support $SU_{2300}$. In this orientation, the first and third legs 2510 and 2530 of the shelf support $SU_{2500}$ extend generally horizontally in the X-direction, and the shelf support $SU_{2500}$ is oriented generally parallel to the X-Y plane. In certain embodiments, the shelf support $SU_{2500}$ is attached to one or more of stretchers $ST_{2300}$ and $ST_{2400}$ in any suitable manner, such as any of those referenced above.

The shelf support $SU_{2600}$ is supported by the stretchers $ST_{2300}$ and $ST_{2400}$. More specifically, the shelf support $SU_{2600}$ is positioned and oriented so the second leg 2620 of the shelf support $SU_{2600}$ extends generally vertically in the Y-direction and is positioned above the second leg 2420 of the shelf support $SU_{2400}$ and the fourth leg 2640 of the shelf support $SU_{2600}$ extends generally vertically in the Y-direction and is positioned above the fourth leg 2440 of the shelf support $SU_{2400}$. In this orientation, the first and third legs 2610 and 2630 of the shelf support $SU_{2600}$ extend generally horizontally in the X-direction, and the shelf support $SU_{2600}$ is oriented generally parallel to the X-Y plane. In certain embodiments, the shelf support $SU_{2600}$ is attached to one or more of stretchers $ST_{2300}$ and $ST_{2400}$ in any suitable manner, such as any of those referenced above.

The stretcher $ST_{2500}$ is supported by and extends between and connects the shelf supports $SU_{2500}$ and $SU_{2600}$. More specifically, the stretcher $ST_{2500}$ is positioned with one end above the fourth leg 2540 of the shelf support $SU_{2500}$ and the other end above the second leg 2620 of the shelf support $SU_{2600}$. The stretcher $ST_{2500}$ extends generally horizontally in the Z-direction. In certain embodiments, the stretcher $ST_{2500}$ is attached to the shelf supports $SU_{2500}$ and $SU_{2600}$ in any suitable manner, such as any of those referenced above.

The stretcher $ST_{2600}$ is supported by and extends between and connects the shelf supports $SU_{2500}$ and $SU_{2600}$. More specifically, the stretcher $ST_{2600}$ is spaced-apart from the stretcher $ST_{2500}$ in the X-direction and positioned with one end above the second leg 2520 of the shelf support $SU_{2500}$ and the other end above the fourth leg 2640 of the shelf support $SU_{2600}$. The stretcher $ST_{2600}$ extends generally horizontally in the Z-direction. In certain embodiments, the stretcher $ST_{2600}$ is attached to the shelf supports $SU_{2500}$ and $SU_{2600}$ in any suitable manner, such as any of those referenced above.

The shelf support $SU_{2700}$ is supported by the stretchers $ST_{2500}$ and $ST_{2600}$. More specifically, the shelf support $SU_{2700}$ is positioned and oriented so the second leg 2720 of the shelf support $SU_{2700}$ extends generally vertically in the Y-direction and is positioned above the second leg 2520 of the shelf support $SU_{2500}$ and the fourth leg 2740 of the shelf support $SU_{2700}$ extends generally vertically in the Y-direction and is positioned above the fourth leg 2540 of the shelf support $SU_{2500}$. In this orientation, the first and third legs 2710 and 2730 of the shelf support $SU_{2700}$ extend generally horizontally in the X-direction, and the shelf support $SU_{2700}$ is oriented generally parallel to the X-Y plane. In certain embodiments, the shelf support $SU_{2700}$ is attached to one or more of stretchers $ST_{2500}$ and $ST_{2600}$ in any suitable manner, such as any of those referenced above.

The shelf support $SU_{2800}$ is supported by the stretchers $ST_{2500}$ and $ST_{2600}$. More specifically, the shelf support $SU_{2800}$ is positioned and oriented so the second leg 2820 of the shelf support $SU_{2800}$ extends generally vertically in the Y-direction and is positioned above the second leg 2620 of the shelf support $SU_{2600}$ and the fourth leg 2840 of the shelf support $SU_{2800}$ extends generally vertically in the Y-direction and is positioned above the fourth leg 2640 of the shelf support $SU_{2600}$. In this orientation, the first and third legs 2810 and 2830 of the shelf support $SU_{2800}$ extend generally horizontally in the X-direction, and the shelf support $SU_{2800}$ is oriented generally parallel to the X-Y plane. In certain embodiments, the shelf support $SU_{2800}$ is attached to one or more of stretchers $ST_{2500}$ and $ST_{2600}$ in any suitable manner, such as any of those referenced above.

The stretcher $ST_{2700}$ is supported by and extends between and connects the shelf supports $SU_{2700}$ and $SU_{2800}$. More specifically, the stretcher $ST_{2700}$ is positioned with one end above the fourth leg 2740 of the shelf support $SU_{2700}$ and the other end above the second leg 2820 of the shelf support $SU_{2800}$. The stretcher $ST_{2700}$ extends generally horizontally in the Z-direction. In certain embodiments, the stretcher $ST_{2700}$ is attached to the shelf supports $SU_{2700}$ and $SU_{2800}$ in any suitable manner, such as any of those referenced above.

The stretcher $ST_{2800}$ is supported by and extends between and connects the shelf supports $SU_{2700}$ and $SU_{2800}$. More specifically, the stretcher $ST_{2800}$ is spaced-apart from the stretcher $ST_{2700}$ in the X-direction and positioned with one end above the second leg 2720 of the shelf support $SU_{2700}$ and the other end above the fourth leg 2840 of the shelf support $SU_{2800}$. The stretcher $ST_{2800}$ extends generally horizontally in the Z-direction. In certain embodiments, the stretcher $ST_{2800}$ is attached to the shelf supports $SU_{2700}$ and $SU_{2800}$ in any suitable manner, such as any of those referenced above.

The height (not labeled) of this embodiment of the storage, shipping, and display unit is generally equal to the sum of the lengths of the vertically aligned legs of the shelf supports. The width (not labeled) of this embodiment of the storage, shipping, and display unit is generally equal to the lengths of the shelf supports $SU_{1100}$-$SU_{1800}$. The depth (not labeled) of this embodiment of the storage, shipping, and display unit is generally equal to the lengths of the first and third legs of the stretchers $ST_{1100}$-$ST_{1800}$.

In other embodiments, some or all of the stretchers nest into and are supported by the shelf supports. In certain of these embodiments, the shelf supports directly contact and directly support one another, and the stretchers directly contact and directly support the shelves while providing rigidity to the frame. For instance, in one of these embodiments, the stretcher $ST_{2100}$ nests within and extends between one of the legs of the shelf supports $SU_{2300}$ and $SU_{2400}$ such that the shelf supports $SU_{2100}$ and $SU_{2200}$ directly contact and directly support those legs of the shelf supports $SU_{2300}$ and $SU_{2400}$.

The invention claimed is:

1. A storage, shipping, and display unit comprising:

a frame comprising:

spaced-apart first and second shelf supports;

spaced-apart first and second stretchers extending between and supported by the first and second shelf supports; and spaced-apart third and fourth shelf supports supported by the first and second shelf supports, wherein the first and second shelf supports are spaced-apart in a first direction, the first and second stretchers are spaced-apart in a second direction, and the third and fourth shelf supports are spaced-apart in the second direction, wherein the second direction is transverse to the first direction;

a first shelf supported by and extending between the first and second shelf supports, wherein the first and second shelf supports inhibits a first side-to-side movement of the first shelf; and a second shelf supported by and extending between the third and fourth shelf supports, wherein the third and fourth shelf supports inhibits a second side-to-side movement of the second shelf.

2. The storage, shipping, and display unit of claim 1, wherein the first and second shelf supports directly contact the third and fourth shelf supports.

3. The storage, shipping, and display unit of claim 1, wherein the third and fourth shelf supports are supported by the first and second stretchers.

4. The storage, shipping, and display unit of claim 3, wherein the first and second stretchers each extend in the first direction.

5. The storage, shipping, and display unit of claim 4, wherein the first and second shelf supports are parallel to one another, the third and fourth shelf supports are parallel to one another, and the first and second shelf supports are each transverse to each of the third and fourth shelf supports.

6. The storage, shipping, and display unit of claim 4, wherein each shelf support comprises first, second, third, and fourth legs, wherein for each shelf support the first leg is opposite the third leg, the second leg is opposite the fourth leg, and the first and third legs are transverse to the second and fourth legs so the legs form a rectangular shape.

7. The storage, shipping, and display unit of claim 6, wherein:

the fourth leg of the first shelf support and the second leg of the third shelf support extend in third direction, are aligned with one another, and are separated by the first stretcher;

the second leg of the second shelf support and the fourth leg of the third shelf support extend in the third direction, are aligned with one another, and are separated by the first stretcher;

the second leg of the first shelf support and the fourth leg of the fourth shelf support extend in the third direction, are aligned with one another, and are separated by the second stretcher;

the fourth leg of the second shelf support and the second leg of the fourth shelf support extend in the third direction, are aligned with one another, and are separated by the second stretcher; and the third direction is transverse to the first direction and second directions.

8. The storage, shipping, and display unit of claim 7, further comprising third and fourth stretchers that are spaced-apart in the first direction, extend in the second direction between the third and fourth shelf supports, and are supported by the third and fourth shelf supports, wherein the third and fourth stretchers are longer than the first and second stretchers.

9. The storage, shipping, and display unit of claim 7, further comprising a base support supporting the first and second shelf supports.

10. The storage, shipping, and display unit of claim 9, further comprising:

a first vertical stabilizer extending in the third direction and positioned adjacent the second leg of the first shelf support and the fourth leg of the fourth shelf support, wherein a bottom end of the first vertical stabilizer is sandwiched between the base support and the first shelf support;

a second vertical stabilizer extending in the third direction and positioned adjacent the fourth leg of the first shelf support and the second leg of the third shelf support, wherein a bottom end of the second vertical stabilizer is sandwiched between the base support and the first shelf support;

a third vertical stabilizer extending in the third direction and positioned adjacent the second leg of the second shelf support and the fourth leg of the third shelf support, wherein a bottom end of the third vertical stabilizer is sandwiched between the base support and the second shelf support; and a fourth vertical stabilizer extending in the third direction and positioned adjacent the fourth leg of the second shelf support and the second leg of the fourth shelf support, wherein a bottom end of the fourth vertical stabilizer is sandwiched between the base support and the second shelf support.

11. The storage, shipping, and display unit of claim 3, wherein the first stretcher is connected to the first, second, and third shelf supports, and wherein the second stretcher is connected to the first, second, and fourth shelf supports.

12. The storage, shipping, and display unit of claim 1, wherein the first and second shelf supports prevent the first side-to-side movement of the first shelf, and wherein the third and fourth shelf supports prevent the second side-to-side movement of the second shelf.

13. The storage, shipping, and display unit of claim 1, wherein the first and second shelf supports inhibit a first front-to-back movement of the first shelf, and wherein the third and fourth shelf supports inhibit a second front-to-back movement of the second shelf.

14. A storage, shipping, and display unit comprising:

a frame comprising:

spaced-apart first and second shelf supports;

spaced-apart first and second stretchers extending between and supported by the first and second shelf supports; and spaced-apart third and fourth shelf supports supported by the first and second shelf supports, wherein the first and second shelf supports are spaced-apart in a first direction, the first and second stretchers are spaced-apart in second direction, and the third and fourth shelf supports are spaced-apart in the second direction, wherein the second direction is transverse to the first direction;

a first shelf supported by and extending between the first and second shelf supports; and a second shelf supported by and extending between the third and fourth shelf supports.

15. The storage, shipping, and display unit of claim 14, wherein the first and second shelf supports directly contact the third and fourth shelf supports.

16. The storage, shipping, and display unit of claim 14, wherein the third and fourth shelf supports are supported by the first and second stretchers.

17. The storage, shipping, and display unit of claim 14, wherein the first and second stretchers each extend in the first direction.

18. The storage, shipping, and display unit of claim 17, wherein the first and second shelf supports are parallel to one another, the third and fourth shelf supports are parallel to one another, and the first and second shelf supports are each transverse to each of the third and fourth shelf supports.

19. The storage, shipping, and display unit of claim 17, wherein each shelf support comprises first, second, third, and fourth legs, wherein for each shelf support the first leg is opposite the third leg, the second leg is opposite the fourth leg, and the first and third legs are transverse to the second and fourth legs so the legs form a rectangular shape.

20. The storage, shipping, and display unit of claim 19, wherein:

the fourth leg of the first shelf support and the second leg of the third shelf support extend in third direction, are aligned with one another, and are separated by the first stretcher;

the second leg of the second shelf support and the fourth leg of the third shelf support extend in the third direction, are aligned with one another, and are separated by the first stretcher;

the second leg of the first shelf support and the fourth leg of the fourth shelf support extend in the third direction, are aligned with one another, and are separated by the second stretcher;

the fourth leg of the second shelf support and the second leg of the fourth shelf support extend in the third direction, are aligned with one another, and are separated by the second stretcher; and the third direction is transverse to the first direction and second directions.

21. The storage, shipping, and display unit of claim 20, further comprising third and fourth stretchers that are spaced-apart in the first direction, extend in the second direction between the third and fourth shelf supports, and are supported by the third and fourth shelf supports, wherein the third and fourth stretchers are longer than the first and second stretchers.

22. The storage, shipping, and display unit of claim 20, further comprising a base support supporting the first and second shelf supports.

23. The storage, shipping, and display unit of claim 22, further comprising:

a first vertical stabilizer extending in the third direction and positioned adjacent the second leg of the first shelf support and the fourth leg of the fourth shelf support, wherein a bottom end of the first vertical stabilizer is sandwiched between the base support and the first shelf support;

a second vertical stabilizer extending in the third direction and positioned adjacent the fourth leg of the first shelf support and the second leg of the third shelf support, wherein a bottom end of the second vertical stabilizer is sandwiched between the base support and the first shelf support;

a third vertical stabilizer extending in the third direction and positioned adjacent the second leg of the second shelf support and the fourth leg of the third shelf support, wherein a bottom end of the third vertical stabilizer is sandwiched between the base support and the second shelf support; and a fourth vertical stabilizer extending in the third direction and positioned adjacent the fourth leg of the second shelf support and the second leg of the fourth shelf support, wherein a bottom end of the fourth vertical stabilizer is sandwiched between the base support and the second shelf support.

* * * * *